US008858192B2

(12) United States Patent
Shikano et al.

(10) Patent No.: US 8,858,192 B2
(45) Date of Patent: Oct. 14, 2014

(54) SCREW COMPRESSOR

(75) Inventors: Shigeharu Shikano, Sakai (JP); Nozomi Gotou, Sakai (JP); Norio Matsumoto, Sakai (JP); Hideyuki Gotou, Sakai (JP); Harunori Miyamura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 444 days.

(21) Appl. No.: 13/256,572

(22) PCT Filed: Mar. 15, 2010

(86) PCT No.: PCT/JP2010/001849

§ 371 (c)(1),
(2), (4) Date: Sep. 14, 2011

(87) PCT Pub. No.: WO2010/106787

PCT Pub. Date: Sep. 23, 2010

(65) Prior Publication Data

US 2012/0003113 A1 Jan. 5, 2012

(30) Foreign Application Priority Data

Mar. 16, 2009 (JP) ..... 2009-062503

(51) Int. Cl.

| | |
|---|---|
| ***F04B 39/04*** | (2006.01) |
| ***F04C 18/16*** | (2006.01) |
| ***F04C 29/02*** | (2006.01) |
| ***F04C 18/52*** | (2006.01) |

(52) U.S. Cl.

CPC ..... *F04C 18/16* (2013.01); *F04C 29/021* (2013.01); *F04C 18/52* (2013.01); *F04C 29/028* (2013.01)

USPC ..... 417/228; 418/195

(58) Field of Classification Search

USPC ..... 418/195; 417/228

See application file for complete search history.

(56) References Cited

U.S. PATENT DOCUMENTS

| | | | | |
|---|---|---|---|---|
| 4,074,957 A * | 2/1978 | Clarke et al. | ..... | 418/195 |
| 4,747,755 A * | 5/1988 | Ohtsuki et al. | ..... | 417/282 |
| 5,765,392 A * | 6/1998 | Baur | ..... | 62/473 |

FOREIGN PATENT DOCUMENTS

| | | |
|---|---|---|
| JP | 53-99615 U | 1/1977 |
| JP | 57-140591 U | 8/1982 |
| JP | 2-248678 A | 10/1990 |
| JP | 3-81591 A | 4/1991 |
| JP | 6-42474 A | 2/1994 |
| JP | 8-42476 A | 2/1996 |

* cited by examiner

*Primary Examiner* — Charles Freay

(74) *Attorney, Agent, or Firm* — Global IP Counselors

(57) ABSTRACT

A screw compressor includes a casing, a screw rotor, an oil sump containing lubricant oil, a lubrication passage and a flow rate controller. The screw rotor is inserted in a cylinder portion of the casing to form a fluid chamber. The screw rotor rotates to suck a fluid into the fluid chamber for compression. The lubrication passage supplies the lubricant oil in the oil sump to the fluid chamber due to a difference in pressure between the oil sump and the fluid chamber. The flow rate controller reduces a flow rate of the lubricant oil supplied to the fluid chamber in accordance with a decrease in operating capacity of the screw compressor.

2 Claims, 14 Drawing Sheets

SCREW COMPRESSOR

CROSS-REFERENCE TO RELATED APPLICATIONS

This U.S. National stage application claims priority under 35 U.S.C. §119(a) to Japanese Patent Application No. 2009-062503, filed in Japan on Mar. 16, 2009, the entire contents of which are hereby incorporated herein by reference.

TECHNICAL FIELD

The present invention relates to measures to improve efficiency of screw compressors.

BACKGROUND ART

Screw compressors have been used as compressors for compressing a refrigerant or air. For example, Japanese Patent Publication No. H06-042474 discloses a single screw compressor including a screw rotor, and two gate rotors.

The single screw compressor will be described below. The screw rotor is substantially in the shape of a column, and a plurality of helical grooves are formed in an outer peripheral surface thereof. The screw rotor is contained in a casing. The helical grooves of the screw rotor constitute fluid chambers. Each of the gate rotors is substantially in the shape of a flat plate. The gate rotor includes a plurality of rectangular plate-shaped gates which are radially arranged. The gates of the gate rotor mesh with the helical grooves of the screw rotor. When the screw rotor is rotated, the gates move relatively from the start ends (ends through which the fluid is sucked) to terminal ends (ends through which the fluid is discharged) of the helical grooves, and the fluid is sucked into the fluid chambers for compression.

A screw compressor disclosed by Japanese Patent Publication No. H03-081591 includes a lubrication passage for supplying lubricant oil to the fluid chambers. In the screw compressor disclosed by Japanese Patent Publication No. H03-081591, a sump for collecting the lubricant oil is formed in the casing, and the lubricant oil in the sump is supplied to the fluid chambers due to difference in pressure between the sump and the fluid chamber. The lubricant oil supplied to the fluid chamber is used to lubricate the screw rotor sliding on the casing, and to seal between the screw rotor and the casing to ensure gastightness of the fluid chambers. The lubricant oil supplied to the fluid chamber is used to cool the fluid compressed in the fluid chamber, or the screw rotor.

SUMMARY

Technical Problem

Temperature of the fluid compressed in the fluid chamber, and temperature of the screw rotor increase with increase in operating capacity of the screw compressor. Thus, the amount of the lubricant oil required to reduce the temperature increase of the fluid in the fluid chamber and the screw rotor increases with the increase in operating capacity of the screw compressor.

In the conventional screw compressor described above, the lubricant oil in the sump is supplied to the fluid chamber due to the difference in pressure between the sump and the fluid chamber. Specifically, when the difference in pressure between the sump and the fluid chamber is constant, a flow rate of the lubricant oil supplied from the sump to the fluid chamber is substantially kept constant even when the operating capacity of the screw compressor is changed. Thus, even when the operating capacity of the screw compressor is low, the flow rate of the lubricant oil supplied to the fluid chamber is kept as high as the flow rate required in accordance with the high operating capacity.

When the screw compressor is operated, the screw rotor is rotated while stirring the lubricant oil supplied to the fluid chamber. The lubricant oil is viscous to a certain extent. Thus, the screw rotor is rotated against the viscosity of the lubricant oil. Specifically, power transmitted from a power source such as an electric motor etc. to the screw rotor is used not only to compress the fluid in the fluid chamber, but also to rotate the screw rotor against the viscosity of the lubricant oil. Thus, the flow rate of the lubricant oil supplied to the fluid chamber is preferably as low as possible at which the screw rotor is reliably lubricated and cooled.

In the conventional screw compressor in which the lubricant oil in the sump is supplied to the fluid chamber due to the difference in pressure between the sump and the fluid chamber, the flow rate of the lubricant oil supplied to the fluid chamber is substantially constant irrespective of the operating capacity of the screw compressor. Thus, when the operating capacity of the screw compressor is low, the flow rate of the lubricant oil supplied to the fluid chamber is too high, and greater power is required to rotate the screw rotor against the viscosity of the lubricant oil. This disadvantageously reduces efficiency of operation of the screw compressor.

In view of the foregoing, the present invention has been achieved. An object of the present invention is to improve the efficiency of operation of the screw compressor by reducing power required to rotate the screw rotor when the operating capacity of the screw compressor is low.

Solution to the Problem

A first aspect of the invention is directed to a screw compressor including: a casing (10); and a screw rotor (40) which is inserted in a cylinder portion (30, 35) of the casing (10) to form a fluid chamber (23), the screw rotor (40) rotating to suck a fluid into the fluid chamber (23) for compression. The screw compressor includes an oil sump (17) which contains lubricant oil, a lubrication passage (110) which supplies the lubricant oil in the oil sump (17) to the fluid chamber (23) due to a difference in pressure between the oil sump (17) and the fluid chamber (23), and a flow rate controller (100) which reduces a flow rate of the lubricant oil supplied to the fluid chamber (23) in accordance with decrease in operating capacity of the screw compressor.

In the first aspect of the invention, the screw rotor (40) is contained in the casing (10). When the screw rotor (40) is rotated by an electric motor etc., the fluid is sucked into the fluid chamber (23), and is compressed. The lubricant oil in the oil sump (17) is supplied to the fluid chamber (23) formed by the screw rotor (40) through the lubrication passage (110). When the screw compressor (1) is operated, the screw rotor (40) is rotated while stirring the lubricant oil supplied to the fluid chamber (23). The flow rate controller (100) adjusts the flow rate of the lubricant oil supplied from the oil sump (17) to the fluid chamber (23) through the lubrication passage (110) in accordance with the operating capacity of the screw compressor (1). Specifically, the flow rate controller (100) reduces the flow rate of the lubricant oil supplied to the fluid chamber (23) as the operating capacity of the screw compressor (1) decreases. The flow rate controller (100) may change the flow rate of the lubricant oil supplied to the fluid chamber (23) in a continuous or stepwise manner.

According to a second aspect of the invention related to the first aspect of the invention, the screw compressor further includes: low pressure space (S1) which is formed in the casing (10), and into which uncompressed, low pressure fluid flows; a bypass passage (33) which is opened in an inner peripheral surface of the cylinder portion (30, 35) to communicate the fluid chamber (23) which finished a suction phase with the low pressure space (S1); and a slide valve (70) which slides in an axial direction of the screw rotor (40) to change an opening area of the bypass passage (33) in the inner peripheral surface of the cylinder portion (30, 35), wherein the lubrication passage (110) includes a stationary oil passage (120) having an outlet end (121) which is opened in a sliding surface (37) of the cylinder portion (30, 35) sliding on the slide valve (70), and a movable oil passage (130) having an inlet end (131) which is opened in a sliding surface (76) of the slide valve (70) sliding on the cylinder portion (30, 35), and an outlet end (132) which is opened in a sliding surface (72) of the slide valve (70) sliding on the screw rotor (40), the stationary oil passage (120) and the movable oil passage (130) are configured in such a manner that an area of the inlet end (131) of the movable oil passage (130) overlapping with the outlet end (121) of the stationary oil passage (120) is reduced as the slide valve (70) is moved to increase the opening area of the bypass passage (33), and the stationary oil passage (120) and the movable oil passage (130) constitute the flow rate controller (100).

In the second aspect of the invention, the screw compressor (1) includes the slide valve (70). When the slide valve (70) is moved, the opening area of the bypass passage (33) opened in the inner peripheral surface of the cylinder portion (30, 35) is changed. The change in opening area of the bypass passage (33) changes the operating capacity of the screw compressor (1). Specifically, when the slide valve (70) is moved to increase the opening area of the bypass passage (33), the flow rate of the fluid returning from the fluid chamber (23) to the low pressure space (S1) through the bypass passage (33) is increased, and the operating capacity of the screw compressor (1) is reduced. Conversely, when the slide valve (70) is moved to reduce the opening area of the bypass passage (33), the flow rate of the fluid returning from the fluid chamber (23) to the low pressure space (S1) through the bypass passage (33) is reduced, and the operating capacity of the screw compressor (1) is increased.

In the second aspect of the invention, the stationary oil passage (120) is formed the cylinder portion (30, 35), and the movable oil passage (130) is formed in the slide valve (70). The lubricant oil flowing from the oil sump (17) to the fluid chamber (23) passes through the outlet end (121) of the stationary oil passage (120) and the inlet end (131) of the movable oil passage (130), and is supplied to the fluid chamber (23) through the outlet end (132) of the movable oil passage (130). In the present invention, the area of the inlet end (131) of the movable oil passage (130) overlapping with the outlet end (121) of the stationary oil passage (120) is reduced as the slide valve (70) is moved to increase the opening area of the bypass passage (33). Thus, when the opening area of the bypass passage (33) is increased, and the operating capacity of the screw compressor (1) is reduced, the flow rate of the lubricant oil flowing from the stationary oil passage (120) to the movable oil passage (130) is reduced, and the flow rate of the lubricant oil supplied from the movable oil passage (130) to the fluid chamber (23) is reduced.

According to a third aspect of the invention related to the second aspect of the invention, the inlet end (131) of the movable oil passage (130) is divided into a plurality of branch passages (133, 134), and the branch passages (133, 134) of the movable oil passage (130) are opened in the sliding surface (76) of the cylinder portion (30, 35) sliding on the slide valve (70) in such a manner that the number of the branch passages (133, 134) communicating with the stationary oil passage (120) is reduced as the slide valve (70) is moved to increase the opening area of the bypass passage (33).

In the third aspect of the invention, the branch passages (133, 134) of the movable oil passage (130) are opened in the sliding surface (76) of the slide valve (70) sliding on the cylinder portion (30, 35). The number of the branch passages (133, 134) of the movable oil passage (130) communicating with the stationary oil passage (120) is reduced as the slide valve (70) is moved to increase the opening area of the bypass passage (33). Specifically, when the slide valve (70) is moved to increase the opening area of the bypass passage (33), the area of the inlet end (131) of the movable oil passage (130) overlapping with the outlet end (121) of the stationary oil passage (120) is reduced.

According to a fourth aspect of the invention related to the first aspect of the invention, the screw compressor further includes: an opening-variable flow rate control valve (111) which adjusts the flow rate of the lubricant oil flowing through the lubrication passage (110); and an opening controller (142) which reduces the degree of opening of the flow rate control valve (111) in accordance with decrease in operating capacity of the screw compressor, wherein the flow rate control valve (111) and the opening controller (142) constitute the flow rate controller (100).

In the fourth aspect of the invention, when the degree of opening of the flow rate control valve (111) is changed, the flow rate of the lubricant oil flowing through the lubrication passage (110) is changed, and the flow rate of the lubricant oil supplied to the fluid chamber (23) through the lubrication passage (110) is changed. When the operating capacity of the screw compressor (1) is reduced, opening controller (142) reduces the degree of the opening of the flow rate control valve (111). Thus, when the operating capacity of the screw compressor (1) is reduced, the flow rate of the lubricant oil supplied to the fluid chamber (23) through the lubrication passage (110) is reduced.

According to a fifth aspect of the invention related to the fourth aspect of the invention, the screw compressor further includes: a rotational speed-variable electric motor (15) for driving the screw rotor (40), wherein the opening controller (142) is configured to reduce the degree of opening of the flow rate control valve (111) in accordance with decrease in rotational speed of the electric motor (15).

In the fifth aspect of the invention, the screw rotor (40) is driven by the electric motor (15). When the rotational speed of the electric motor (15) is changed, the rotational speed of the screw rotor (40) is changed, and the operating capacity of the screw compressor (1) is changed. The operating capacity of the screw compressor (1) decreases with decrease rotational speed of the screw. Thus, the opening controller (142) adjusts the degree of opening of the flow rate control valve (111) in accordance with the rotational speed of the electric motor (15). Specifically, when the rotational speed of the electric motor (15) is reduced, the opening controller (142) reduces the degree of opening of the flow rate control valve (111). Therefore, the flow rate of the lubricant oil supplied to the fluid chamber (23) through the lubrication passage (110) is reduced.

According to a sixth aspect of the invention related to the fourth aspect of the invention, the screw compressor further includes: low pressure space (S1) which is formed in the casing (10), and into which uncompressed, low pressure fluid flows; a bypass passage (33) which is opened in an inner peripheral surface of the cylinder portion (30, 35) to communicate the fluid chamber (23) which finished a suction phase with the low pressure space (S1); and a slide valve (70) which slides in an axial direction of the screw rotor (40) to change an opening area of the bypass passage (33) in the inner peripheral surface of the cylinder portion (30, 35), wherein the opening controller (142) is configured to reduce the degree of opening of the flow rate control valve (111) as the slide valve (70) is moved to increase the opening area of the bypass passage (33).

In the sixth aspect of the invention, the screw compressor (1) includes the slide valve (70). As described in connection with the second aspect of the invention, the operating capacity of the screw compressor (1) is changed when the slide valve (70) is moved. Specifically, the operating capacity of the screw compressor (1) is reduced when the slide valve (70) is moved to increase the opening area of the bypass passage (33). The operating capacity of the screw compressor (1) is increased when the slide valve (70) is moved to reduce the opening area of the bypass passage (33).

In the sixth aspect of the invention, the operating capacity of the screw compressor (1) is changed when the slide valve (70) is moved. Thus, the opening controller (142) adjusts the degree of opening of the flow rate control valve (111) in accordance with the position of the slide valve (70). Specifically, the opening controller (142) reduces the degree of opening of the flow rate control valve (111) when the slide valve (70) is moved to increase the opening area of the bypass passage (33). Thus, the flow rate of the lubricant oil supplied to the fluid chamber (23) through the lubrication passage (110) is reduced.

According to a seventh aspect of the invention related to any one of the fourth to sixth aspect of the invention, the flow rate control valve (111) and the opening controller (142) are attached to the casing (10).

In the seventh aspect of the invention, the flow rate control valve (111) and the opening controller (142) are attached to the casing (10). The opening controller (142) adjusts the flow rate of the lubricant oil flowing through the lubrication passage (110) by adjusting the degree of opening of the flow rate control valve (111).

Advantages of the Invention

In the screw compressor (1) of the present invention, the lubricant oil is supplied to the fluid chamber (23) due to the difference in pressure between the oil sump (17) and the fluid chamber (23). Thus, unless special measures are taken, the flow rate of the lubricant oil supplied to the fluid chamber (23) is kept constant as long as the difference in pressure between the oil sump (17) and the fluid chamber (23) is constant even when the operating capacity of the screw compressor (1) is changed.

According to the present invention, the screw compressor (1) includes the flow rate controller (100). The flow rate controller (100) reduces the flow rate of the lubricant oil supplied to the fluid chamber (23) when the operating capacity of the screw compressor (1) is reduced.

Specifically, in the screw compressor (1) of the present invention, the flow rate controller (100) reduces the flow rate of the lubricant oil supplied to the fluid chamber (23) when the operating capacity of the screw compressor is reduced and supply of a large amount of the lubricant oil to the fluid chamber (23) is no longer necessary. When the amount of the lubricant oil supplied to the fluid chamber (23) is reduced, power required to rotate the screw rotor (40) against the viscosity of the lubricant oil is reduced.

Thus, according to the present invention, the power required to drive the screw rotor (40) can sufficiently be reduced when the operating capacity of the screw compressor (1) is reduced, and efficiency of operation of the screw compressor (1) can be kept high irrespective of the operating capacity of the screw compressor (1).

In the second and third aspects of the present invention, the area of the inlet end (131) of the movable oil passage (130) overlapping with the outlet end (121) of the stationary oil passage (120) is changed when the slide valve (70) is moved to change the operating capacity of the screw compressor (1). Thus, the flow rate of the lubricant oil flowing from the stationary oil passage (120) to the movable oil passage (130) is reduced, and the flow rate of the lubricant oil supplied from the movable oil passage (130) to the fluid chamber (23) is changed.

According to the second and third aspects of the invention, the flow rate of the lubricant oil supplied from the movable oil passage (130) to the fluid chamber (23) can be changed by using the slide valve (70) which is moved to change the operating capacity of the screw compressor (1). Thus, according to these aspects, the flow rate of the lubricant oil supplied to the fluid chamber (23) can reliably be changed in accordance with the operating capacity of the screw compressor (1) without providing additional sensors and controllers.

According to the fourth, fifth, and sixth aspects of the invention, the opening controller (142) adjusts the degree of opening of the flow rate control valve (111) in accordance with the operating capacity of the screw compressor (1). Thus, according to these aspects, the flow rate of the lubricant oil supplied to the fluid chamber (23) can reliably be set in accordance with the operating capacity of the screw compressor (1).

According to the seventh aspect of the invention, the flow rate control valve (111) is attached to the casing (10). Thus, as compared with the case where the flow rate control valve (111) is arranged away from the casing (10), the lubrication passage (110) can be shortened. Thus, the change in flow rate of the lubricant oil can be more responsive to the change in degree of opening of the flow rate control valve (111), and the flow rate of the lubricant oil supplied to the fluid chamber (23) can precisely be adjusted.

According to the seventh aspect of the invention, both of the flow rate control valve (111) and the opening controller (142) are attached to the casing (10). Thus, connecting the flow rate control valve (111) and the opening controller (142) through wires etc. can be performed in assembling the screw compressor (1) (i.e., before shipping of the screw compressor (1) from the factory). Therefore, in setting the screw compressor (1), the connection of the flow rate control valve (111) and the opening controller (142) is no longer necessary, thereby facilitating the setting of the screw compressor (1).

BRIEF DESCRIPTION OF THE DRAWINGS

FIG. 9(A) shows a suction phase, FIG. 9(B) shows a compression phase, and FIG. 9(C) shows a discharge phase.

DESCRIPTION OF EMBODIMENTS

Embodiments of the present invention will be described in detail below with reference to the drawings.

[First Embodiment]

A single screw compressor (1) of the present embodiment (hereinafter merely referred to as a screw compressor) is provided in a refrigerant circuit for performing a refrigeration cycle, and compresses a refrigerant.

<General Structure of Screw Compressor>

Figure 1:
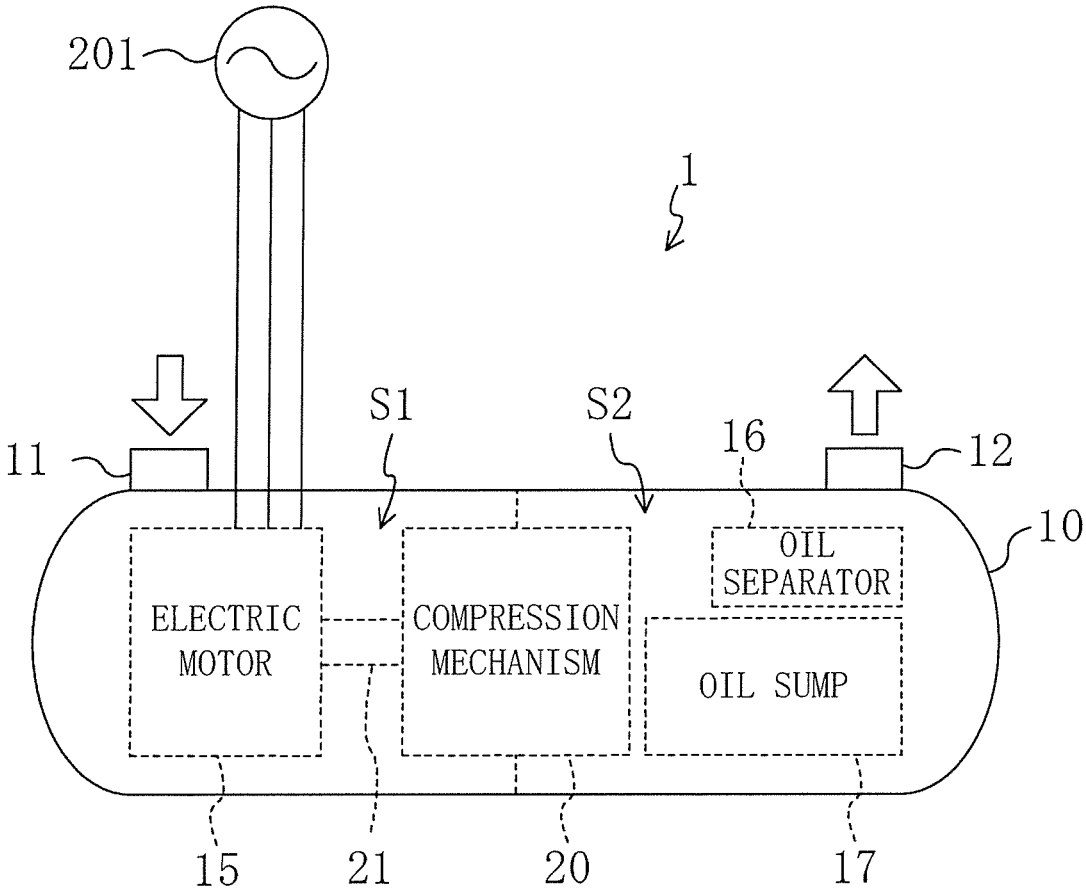
FIG. 1 is a schematic view illustrating a single screw compressor of a first embodiment.

As shown in FIG. 1, the screw compressor (1) includes a casing (10) containing a compression mechanism (20), and an electric motor (15) for driving the compression mechanism. The screw compressor (1) is semi-hermetic.

The casing (10) is in the shape of a horizontally-oriented cylinder. Space inside the casing (10) is divided into low pressure space (S1) close to an end of the casing (10), and high pressure space (S2) close to the other end of the casing (10). A suction pipe connector (11) communicating with the low pressure space (S1), and a discharge pipe connector (12) communicating with the high pressure space (S2) are formed in the casing (10). A low pressure gaseous refrigerant (i.e., low pressure fluid) flowed from an evaporator of the refrigerant circuit passes through the suction pipe connector (11) to enter the low pressure space (S1). A compressed, high pressure gaseous refrigerant discharged from the compression mechanism (20) to the high pressure space (S2) passes through the discharge pipe connector (12), and is supplied to a condenser of the refrigerant circuit.

In the casing (10), the electric motor (15) is arranged in the low pressure space (S1), and the compression mechanism (20) is arranged between the low pressure space (S1) and the high pressure space (S2). A drive shaft (21) of the compression mechanism (20) is coupled to the electric motor (15). A commercial power supply (201) is connected to the electric motor (15) of the screw compressor (1). The electric motor (15) rotates at constant rotational speed when alternating current is supplied from the commercial power supply (201).

An oil separator (16) is arranged in the high pressure space (S2) in the casing (10). The oil separator (16) separates refrigeration oil from the refrigerant discharged from the compression mechanism (20). An oil sump (17) for containing the refrigeration oil as lubricant oil is provided in the high pressure space (S2) below the oil separator (16). The refrigeration oil separated from the refrigerant by the oil separator (16) flows downward, and is contained in the oil sump (17).

Figure 2:
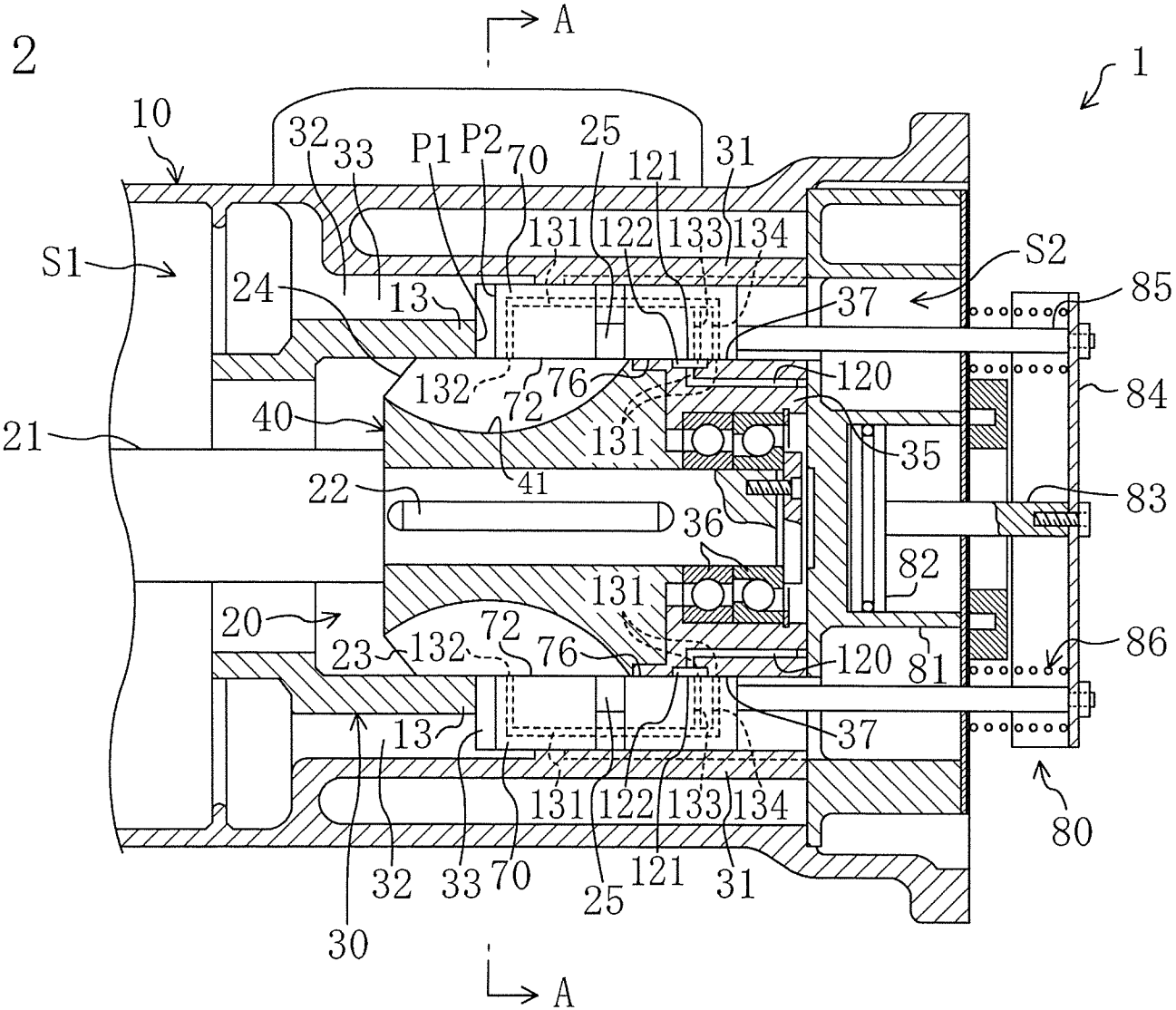
FIG. 2 is a cross-sectional view illustrating a major part of the single screw compressor of the first embodiment.
Figure 3:
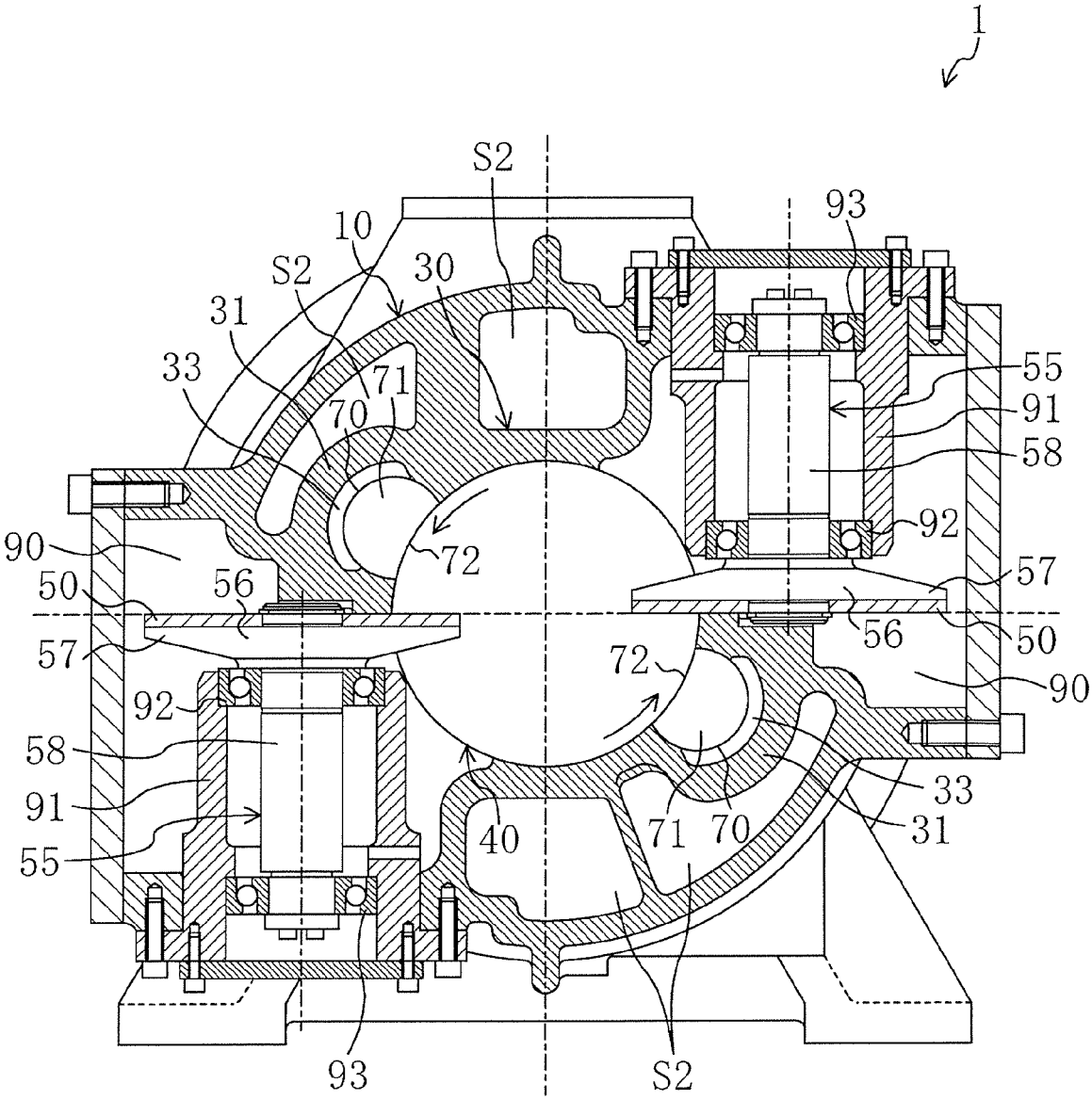
FIG. 3 is a cross-sectional view taken along the line A-A shown in FIG. 2.

As shown in FIGS. 2 and 3, the compression mechanism (20) includes a cylindrical wall (30) formed in the casing (10), a screw rotor (40) arranged in the cylindrical wall (30), and two gate rotors (50) which mesh with the screw rotor (40). The cylindrical wall (30) constitutes a cylinder portion together with a bearing holder (35) described later. The drive shaft (21) is inserted in the screw rotor (40). The screw rotor (40) and the drive shaft (21) are coupled through a key (22). The drive shaft (21) is arranged coaxially with the screw rotor (40).

A bearing holder (35) is inserted in an end of the cylindrical wall (30) closer to the high pressure space (S2). The bearing holder (35) is in the shape of a slightly thick cylinder. An outer diameter of the bearing holder (35) is substantially the same as a diameter of an inner peripheral surface of the cylindrical wall (30) (i.e., a surface which slides on an outer peripheral surface of the screw rotor (40)). Part of an outer peripheral surface of the bearing holder (35) which slides on a slide valve (70) described later constitutes a guide surface (37) which is a sliding surface. Ball bearings (36) are provided in the bearing holder (35). A tip end of the drive shaft (21) is inserted in the ball bearings (36), and the ball bearings (36) rotatably support the drive shaft (21).

Figure 4:
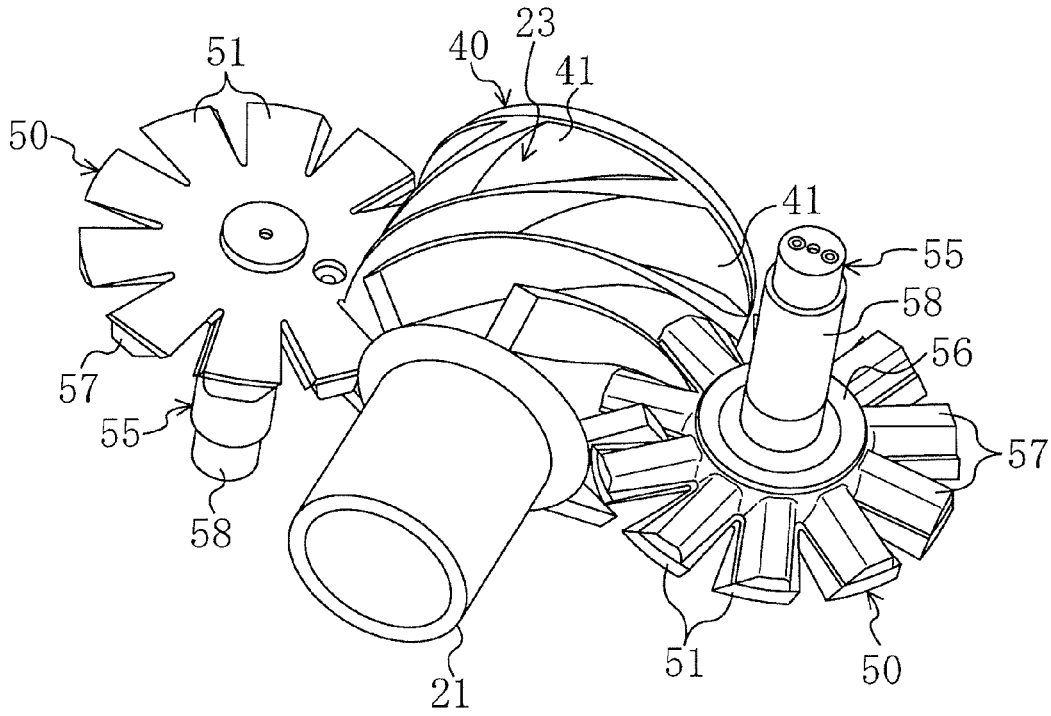
FIG. 4 is a perspective view illustrating a major part of the single screw compressor.

As shown in FIG. 4, the screw rotor (40) is a substantially columnar metal member. The screw rotor (40) is rotatably fitted in the cylindrical wall (30), and the outer peripheral surface thereof slides on the inner peripheral surface of the cylindrical wall (30). A plurality of helical grooves (41) (six helical grooves in the present embodiment), each of which helically extends from an end to the other end of the screw rotor (40), are formed in the outer peripheral surface of the screw rotor (40).

Each of the helical grooves (41) of the screw rotor (40) has a front end in FIG. 4 as a start end, and a back end in FIG. 4 as a terminal end. In FIG. 4, a front end face (an end face through which the refrigerant is sucked) of the screw rotor (40) is tapered. In the screw rotor (40) shown in FIG. 3, the start ends of the helical grooves (41) are opened in the tapered front end face, while the terminal ends of the helical grooves (41) are not opened in a back end face.

Each of the gate rotors (50) is a resin member. Each of the gate rotors (50) includes a plurality of radially arranged, rectangular plate-shaped gates (51) (11 gates in this embodiment). Each of the gate rotors (50) is arranged outside the cylindrical wall (30) to be axially symmetric with the axis of rotation of the screw rotor (40). An axial center of each of the gate rotors (50) is perpendicular to an axial center of the screw rotor (40). Each of the gate rotors (50) is arranged in such a manner that the gates (51) penetrate part of the cylindrical wall (30) to mesh with the helical grooves (41) of the screw rotor (40).

The gate rotors (50) are attached to metal rotor supports (55), respectively (see FIG. 4). Each of the rotor supports (55) includes a base (56), arms (57), and a shaft (58). The base (56) is in the shape of a slightly thick disc. The number of the arms (57) is the same as the number of the gates (51) of the gate rotor (50), and the arms extend radially outward from an outer peripheral surface of the base (56). The shaft (58) is in the shape of a rod, and is placed to stand on the base (56). A center axis of the shaft (58) is aligned with a center axis of the base (56). The gate rotor (50) is attached to be opposite the rod (58)

with respect to the base (56) and the arms (57). The arms (57) are in contact with rear surfaces of the gates (51), respectively.

Each of the rotor supports (55) to which the gate rotor (50) is attached is placed in a gate rotor chamber (90) which is provided adjacent to the cylindrical wall (30) in the casing (10) (see FIG. 3). The rotor support (55) on the right of the screw rotor (40) in FIG. 3 is arranged with the gate rotor (50) facing downward. The rotor support (55) on the left of the screw rotor (40) in FIG. 3 is arranged with the gate rotor (50) facing upward. The shaft (58) of each of the rotor supports (55) is rotatably supported by a bearing housing (91) in the gate rotor chamber (90) through ball bearings (92, 93). Each of the gate rotor chambers (90) communicates with the low pressure space (S1).

In the compression mechanism (20), space surrounded by the inner peripheral surface of the cylindrical wall (30), the helical groove (41) of the screw rotor (40), and the gate (51) of the gate rotor (50) constitutes a fluid chamber (23). An end of the helical groove (41) of the screw rotor (40) through which the refrigerant is sucked is opened toward the low pressure space (S1), and the open end constitutes an inlet (24) of the compression mechanism (20).

The screw compressor (1) includes a slide valve (70) for controlling capacity. The slide valve (70) is placed in a slide valve container (31). The slide valve container (31) is formed with two parts of the cylindrical wall (30) expanded radially outward, and each of the two parts is substantially in the shape of a semi-cylinder extending from a discharge end (a right end in FIG. 2) to a suction end (a left end in FIG. 2). The slide valve (70) is slidable in the axial direction of the cylindrical wall (30), and faces a circumferential surface of the screw rotor (40) when inserted in the slide valve container (31). Details of the slide valve (70) will be described later.

Communication passages (32) are formed in the casing (10) outside the cylindrical wall (30). The communication passages (32) are provided to correspond to the two parts of the slide valve container (31), respectively. The communication passage (32) is a passage extending in the axial direction of the cylindrical wall (30), and has an end opened in the low pressure space (S1) and the other end opened in the suction end of the slide valve container (31). Part of the cylindrical wall (30) adjacent to the other end of the communication passage (32) (a right end in FIG. 2) constitutes a seat portion (13) to which an end face (P2) of the slide valve (70) abuts. A surface of the seat portion (13) facing the end face (P2) of the slide valve (70) constitutes a seat surface (P1).

When the slide valve (70) slides closer to the high pressure space (S2) (to the right provided that the axial direction of the drive shaft (21) shown in FIG. 1 is the right-left direction), an axial clearance is formed between an end face (P1) of the slide valve container (31) and the end face (P2) of the slide valve (70). The axial clearance constitutes a bypass passage (33) together with the communication passage (32) through which the refrigerant returns from the fluid chamber (23) to the low pressure space (S1). Specifically, an end of the bypass passage (33) communicates with the low pressure space (S1), and the other end can be opened in the inner peripheral surface of the cylindrical wall (30). When the slide valve (70) is moved to change the size of the bypass passage (33), capacity of the compression mechanism (20) is changed. The slide valve (70) is provided with an outlet (25) through which the fluid chamber (23) and the high pressure space (S2) communicate with each other.

The screw compressor (1) includes a slide valve driving mechanism (80) for sliding the slide valve (70). The slide valve driving mechanism (80) includes a cylinder (81) fixed to the bearing holder (35), a piston (82) inserted in the cylinder (81), an arm (84) coupled to a piston rod (83) of the piston (82), a coupling rod (85) which couples the arm (84) and the slide valve (70), and a spring (86) which biases the arm (84) to the right in FIG. 1 (to the direction in which the arm (84) is separated from the casing (10)).

In the slide valve driving mechanism (80) shown in FIG. 2, inner pressure in space on the left of the piston (82) (space adjacent to the piston (82) closer the screw rotor (40)) is higher than inner pressure in space on the right of the piston (82) (space adjacent to the piston (82) closer to the arm (84)). The slide valve driving mechanism (80) is configured to adjust the position of the slide valve (70) by adjusting the inner pressure in the space on the right of the piston (82) (i.e., gas pressure in the right space).

When the screw compressor (1) is being operated, suction pressure of the compression mechanism (20) is acted on one of axial end faces of the slide valve (70), and discharge pressure of the compression mechanism (20) is acted on the other axial end face. Thus, during the operation of the screw compressor (1), the slide valve (70) always receives force which presses the slide valve (70) toward the low pressure space (S1). When the inner pressures in the spaces on the left and right of the piston (82) in the slide valve driving mechanism (80) are changed, force which pulls the slide valve (70) back to the high pressure space (S2) is changed, thereby changing the position of the slide valve (70).

<Structure of Slide Valve>

Figure 5:
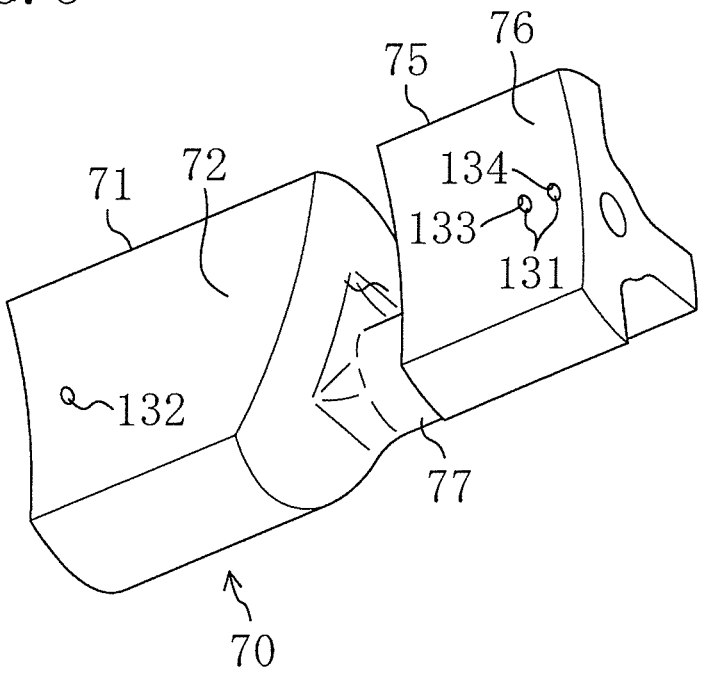
FIG. 5 is a perspective view illustrating a slide valve of the first embodiment.
Figure 6:
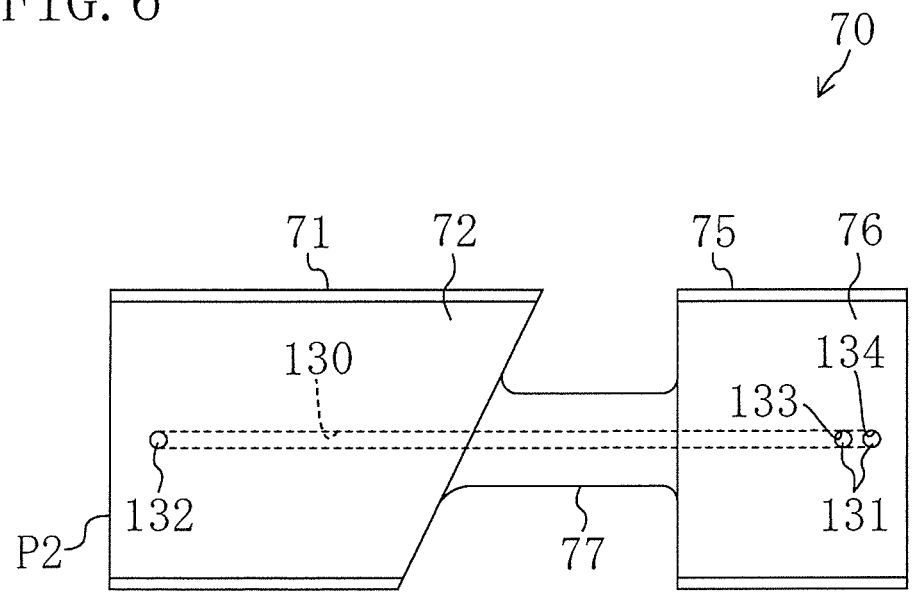
FIG. 6 is a front view of the slide valve of the first embodiment.

The slide valve (70) will be described in detail with reference to FIGS. 5 and 6.

The slide valve (70) includes a valve portion (71), a guide portion (75), and a coupling portion (77). The valve portion (71), the guide portion (75), and the coupling portion (77) of the slide valve (70) are formed with a single metal member. Specifically, the valve portion (71), the guide portion (75), and the coupling portion (77) are integrated.

The valve portion (71) is in the shape of a solid column which is partially cut away as shown in FIG. 3, and is placed in the casing (10) with the cut portion facing the screw rotor (40). A sliding surface (72) of the valve portion (71) facing the screw rotor (40) is a curved surface having the same radius of curvature as the inner peripheral surface of the cylindrical wall (30), and extends in the axial direction of the valve portion (71). The sliding surface (72) of the valve portion (71) slides on the screw rotor (40), and faces the fluid chamber (23) formed by the helical groove (41).

An end face of the valve portion (71) (a left end face in FIG. 6) is a flat surface perpendicular to the axial direction of the valve portion (71). The end face constitutes an end face (P2) which is positioned forward in the sliding direction of the slide valve (70). The other end face of the valve portion (71) (a right end face in FIG. 6) is an inclined surface which is inclined relative to the axial direction of the valve portion (71). The inclination of the inclined end face of the valve portion (71) is the same as the inclination of the helical groove (41) of the screw rotor (40).

The guide portion (75) is in the shape of a column having a T-shaped cross-section. A side surface of the guide portion (75) corresponding to an arm of the T-shaped cross-section (i.e., a front side surface in FIG. 5) is a curved surface having the same radius of curvature as the inner peripheral surface of the cylindrical wall (30), and constitutes a sliding surface (76) which slides on the outer peripheral surface of the bearing holder (35). Specifically, the sliding surface (76) slides on a guide surface (37) of the bearing holder (35). The sliding surface (76) of the guide portion (75) of the slide valve (70) faces the same direction as the sliding surface (72) of the valve portion (71), and is arranged at an interval from the inclined end face of the valve portion (71).

The coupling portion (77) is in the shape of a relatively short column, and couples the valve portion (71) and the guide portion (75). The coupling portion (77) is positioned opposite the sliding surface (72) of the valve portion (71) and the sliding surface (76) of the guide portion (75). Space between the valve portion (71) and the guide portion (75) of the slide valve (70) and space behind the guide portion (75) (space opposite the sliding surface (76)) form a passage for discharged gaseous refrigerant, and space between the sliding surface (72) of the valve portion (71) and the sliding surface (76) of the guide portion (75) is the outlet (25).

<Structure of Lubrication Passage>

The screw compressor (1) includes a lubrication passage (110) through which the refrigeration oil contained in the oil sump (17) to the compression mechanism (20).

As shown in FIG. 2, a stationary oil passage (120) is formed in the bearing holder (35), and a movable oil passage (130) is formed in the slide valve (70). The stationary oil passage (120) and the movable oil passage (130) constitute part of the lubrication passage (110). Although not shown, the stationary oil passage (120) communicates with the oil sump (17).

Figure 7:
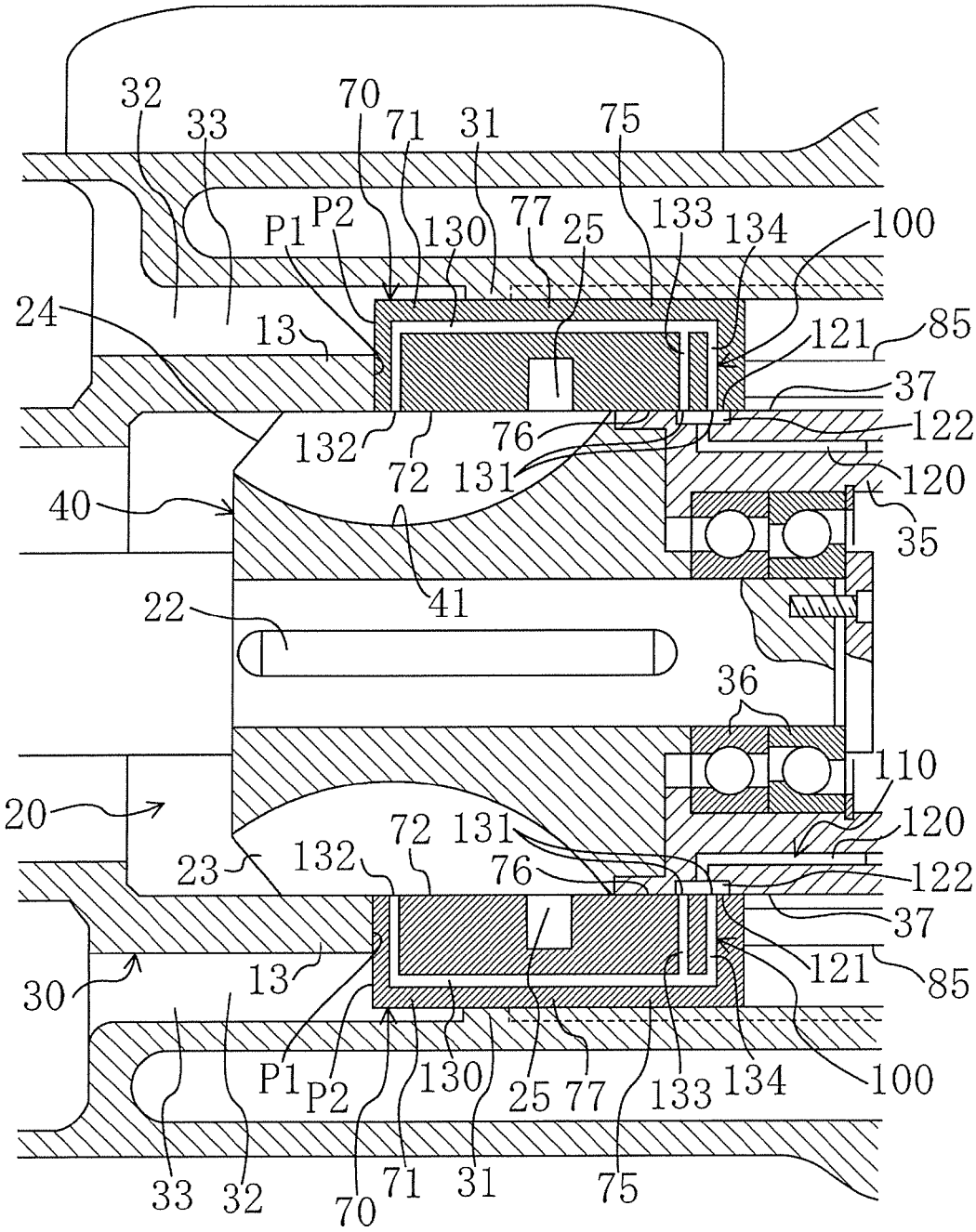
FIG. 7 is a cross-sectional view illustrating part of FIG. 2, enlarged, in which operating capacity of the single screw compressor is the highest.
Figure 8:
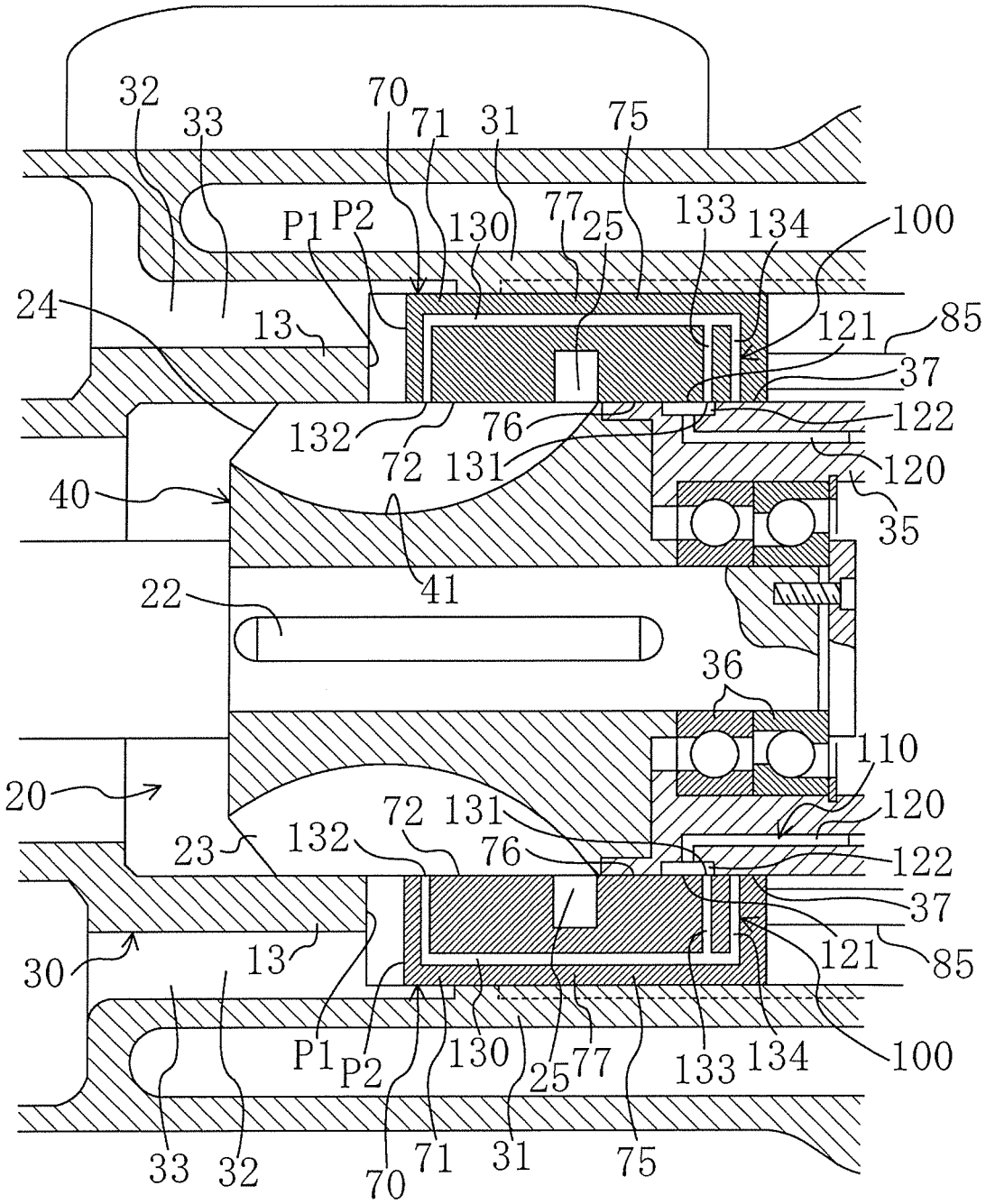
FIG. 8 is a cross-sectional view illustrating part of FIG. 2, enlarged, in which the operating capacity of the single screw compressor is the lowest.

As shown in FIGS. 7 and 8, an outlet end (121) of the stationary oil passage (120) is opened in the guide surface (37) of the bearing holder (35). The outlet end (121) is formed with a recess (122) which is opened in the guide surface (37). The recess (122) is a relatively short groove extending in the sliding direction of the slide valve (70) (i.e., the axial direction of the screw rotor (40)).

An inlet end (131) of the movable oil passage (130) is divided into a first branch passage (133) and a second branch passage (134). As shown in FIGS. 5 and 6, each of the first branch passage (133) and the second branch passage (134) has a round cross-section, and is opened in the sliding surface (76) of the guide portion (75). Open ends of the first branch passage (133) and the second branch passage (134) in the sliding surface (76) constitute the inlet end (131) of the movable oil passage (130). In the sliding surface (76), the open ends of the first branch passage (133) and the second branch passage (134) are aligned in the sliding direction of the slide valve (70) (i.e., the extending direction of the recess (122)). In the sliding surface (76), the open ends of the first branch passage (133) and the second branch passage (134) are arranged to be able to face the recess (122) opened in the guide surface (37) of the bearing holder (35). The positions of the open ends of the branch passages (133, 134) in the sliding surface (76) will be described in detail below.

An outlet end (132) of the movable oil passage (130) is formed in the sliding surface (72) of the valve portion (71). Specifically, the outlet end (132) of the movable oil passage (130) faces the outer peripheral surface of the screw rotor (40). The refrigeration oil discharged out of the outlet end (132) flows into the fluid chamber (23) formed by the helical groove (41) of the screw rotor (40).

The position of the inlet end (131) of the movable oil passage (130) in the sliding surface (76) of the slide valve (70) will be described in detail with reference to FIGS. 7 and 8.

In the state shown in FIG. 7, the slide valve (70) is pushed to be closest to the low pressure space (S1), and the end face (P2) of the slide valve (70) is in close contact with a seat surface (P1) of the cylindrical wall (30). In the state shown in FIG. 8, the slide valve (70) is moved to be closest to the high pressure space (S2), and a distance between the end face (P2) of the slide valve (70) and seat surface (P1) of the cylindrical wall (30) is the largest. Both of the open ends of the first and second branch passages (133, 134) constituting the inlet end (131) of the movable oil passage (130) communicate with the recess (122) in the state shown in FIG. 7, while only the open end of the first branch passage (133) communicates with the recess (122) in the state shown in FIG. 8. In the state shown in FIG. 8, the open end of the second branch passage (134) is closed by the guide surface (37) of the bearing holder (35).

In the screw compressor (1) of the present embodiment, the movable oil passage (130) including the first and second branch passages (133, 134), and the stationary oil passage (120) including the outlet end (121) formed with the recess (122) constitute a flow rate controller (100) which adjusts the flow rate of the refrigeration oil supplied to the fluid chamber (23) in accordance with operating capacity of the screw compressor (1).

—Working Mechanism of Screw Compressor—

Figure 9:
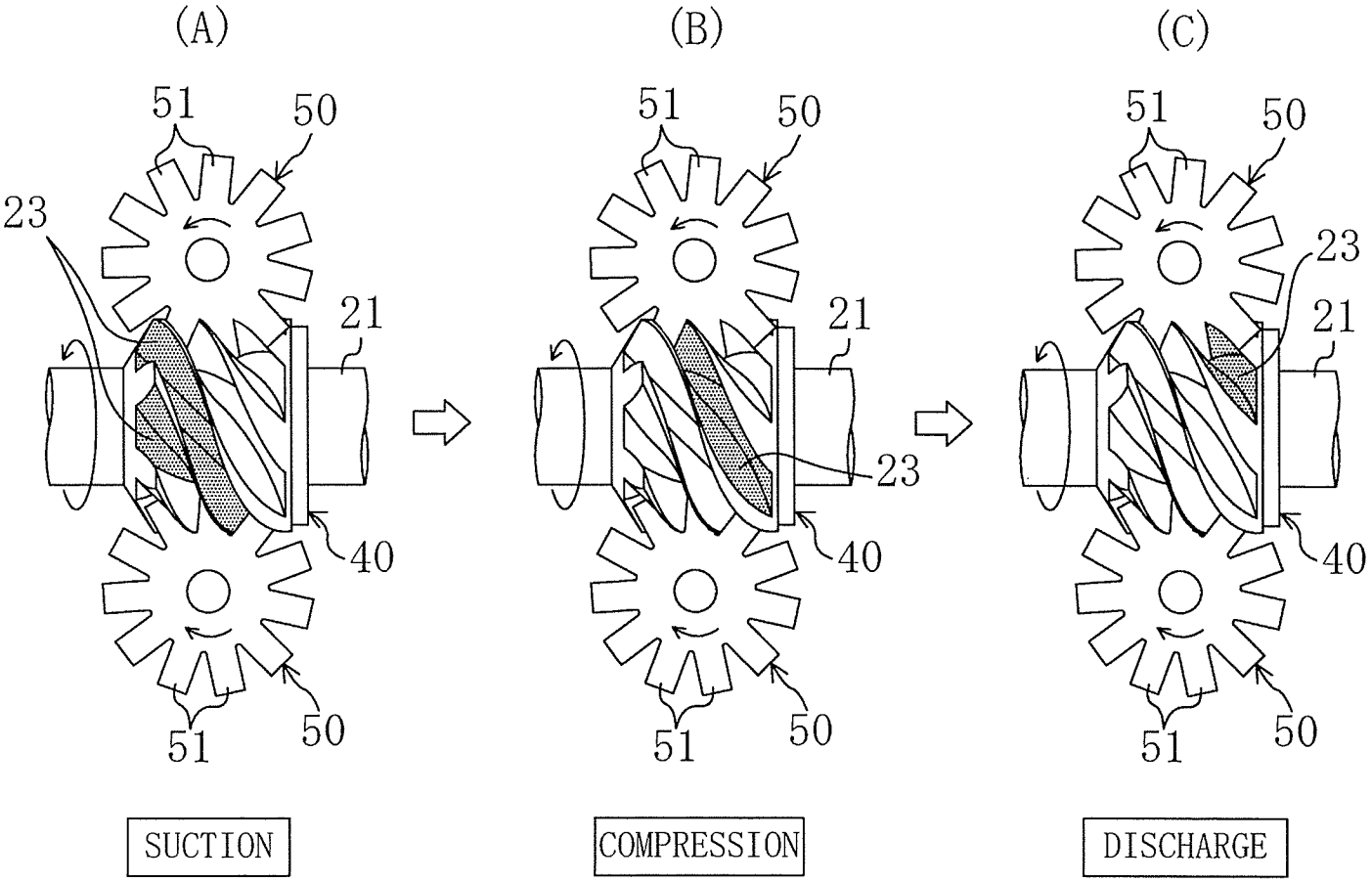
FIGS. 9(A) to 9(C) are plan views illustrating operation of a compression mechanism of the single screw compressor.

A working mechanism of the screw compressor (1) will be described with reference to FIG. 9.

When the electric motor (15) of the screw compressor (1) is driven, the drive shaft (21) is rotated to rotate the screw rotor (40). As the screw rotor (40) is rotated, the gate rotors (50) are also rotated, and a suction phase, a compression phase, and a discharge phase of the compression mechanism (20) are repeated. In the following description, the fluid chamber (23) which is shaded in FIG. 9 will be described.

In FIG. 9(A), the shaded fluid chamber (23) communicates with the low pressure space (S1). The helical groove (41) constituting the fluid chamber (23) meshes with the gate (51) of the lower gate rotor (50) shown in FIG. 9(A). When the screw rotor (40) is rotated, the gate (51) relatively moves toward the terminal end of the helical groove (41), thereby increasing volume of the fluid chamber (23). Thus, the low pressure gaseous refrigerant in the low pressure space (S1) is sucked into the fluid chamber (23) through the inlet (24).

When the screw rotor (40) is further rotated, the fluid chamber (23) is in the state shown in FIG. 9(B). As shown in FIG. 9(B), the shaded fluid chamber (23) is completely closed. Thus, the helical groove (41) constituting this fluid chamber (23) meshes with the gate (51) of the upper gate rotor (50) shown in FIG. 9(B), and is divided from the low pressure space (S1) by the gate (51). When the gate (51) relatively moves toward the terminal end of the helical groove (41) as the screw rotor (40) is rotated, the volume of the fluid chamber (23) gradually decreases. Thus, the gaseous refrigerant in the fluid chamber (23) is compressed.

When the screw rotor (40) is further rotated, the fluid chamber (23) is in the state shown in FIG. 9(C). In FIG. 9(C), the shaded fluid chamber (23) communicates with the high pressure space (S2) through the outlet (25). When the gate (51) relatively moves toward the terminal end of the helical groove (41) as the screw rotor (40) is rotated, the compressed refrigerant gas is pushed out of the fluid chamber (23) to the high pressure space (S2).

—Adjustment of Operating Capacity—

Adjustment of capacity of the compression mechanism (20) using the slide valve (70) will be described with reference to FIG. 2. The capacity of the compression mechanism (20) indicates "an amount of the refrigerant discharged from the compression mechanism (20) to the high pressure space (S2) in unit time." The capacity of the compression mechanism (20) is the same as the operating capacity of the screw compressor (1).

When the slide valve (70) is pushed to the leftmost position in FIG. 2, the end face (P2) of the slide valve (70) is pressed onto the seat surface (P1) of the seat portion (13), and the capacity of the compression mechanism (20) is the highest. In this state, the bypass passage (33) is completely closed by the valve portion (71) of the slide valve (70), and all the gaseous refrigerant sucked from the low pressure space (S1) to the fluid chamber (23) is discharged to the high pressure space (S2).

When the slide valve (70) moves to the right in FIG. 2, and the end face (P2) of the slide valve (70) is separated from the seat surface (P1), the bypass passage (33) is opened in the inner peripheral surface of the cylindrical wall (30). In this state, part of the gaseous refrigerant sucked from the low pressure space (S1) to the fluid chamber (23) returns from the fluid chamber (23) in the compression phase to the low pressure space (S1) through the bypass passage (33), and the rest of the refrigerant is compressed, and is discharged to the high pressure space (S2).

When the distance between the end face (P2) of the slide valve (70) and the seat surface (P1) of the slide valve container (31) is increased (i.e., an opening area of the bypass passage (33) in the inner peripheral surface of the cylindrical wall (30) is increased), the amount of the refrigerant returning to the low pressure space (S1) through the bypass passage (33) is increased, and the amount of the refrigerant discharged to the high pressure space (S2) is reduced. Specifically, the capacity of the compression mechanism (20) is reduced with the increase in distance between the end face (P2) of the slide valve (70) and the seat surface (P1) of the slide valve container (31).

The refrigerant discharged from the fluid chamber (23) to the high pressure space (S2) first flows into the outlet (25) formed in the slide valve (70). Then, the refrigerant flows into the high pressure space (S2) through the passage formed behind the guide portion (75) of the passage slide valve (70).

—Oil Supply to Compression Mechanism—

First, operation of supplying the refrigeration oil in the oil sump (17) to the compression mechanism (20) will be described below.

As described above, the lubrication passage (110) formed in the screw compressor (1) includes the stationary oil passage (120) and the movable oil passage (130), and the stationary oil passage (120) and the movable oil passage (130) communicate with each other. The oil sump (17) to which the lubrication passage (110) is connected is formed in the high pressure space (S2) in the casing (10), and pressure of the refrigeration oil contained in the oil sump (17) is substantially the same as the pressure of the high pressure gaseous refrigerant discharged from the compression mechanism (20). The outlet end (132) of the movable oil passage (130) is opened in the sliding surface (72) of the slide valve (70), and can communicate with the fluid chamber (23) in the suction phase. The low pressure gaseous refrigerant flows from the low pressure space (S1) to the fluid chamber (23) in the suction phase. Specifically, the inner pressure of the fluid chamber (23) in the suction phase is substantially the same as the pressure of the low pressure gaseous refrigerant in the low pressure space (S1).

Thus, the oil sump (17) connected to the lubrication passage (110) and the fluid chamber (23) have a difference in pressure. Thus, the high pressure refrigeration oil in the oil sump (17) flows through the lubrication passage (110), and is supplied to the fluid chamber (23). Specifically, in the screw compressor (1) of the present embodiment, the refrigeration oil in the oil sump (17) is supplied to the fluid chamber (23) due to the difference in pressure between the oil sump (17) and the fluid chamber (23). The refrigeration oil supplied to the fluid chamber (23) is supplied to sliding parts of the compression mechanism (20) (e.g., part of the screw rotor (40) sliding on the cylindrical wall (30)), thereby lubricating the sliding parts. Part of the refrigeration oil which entered the fluid chamber (23) enters a gap between the screw rotor (40) and the cylindrical wall (30) to form an oil film, thereby sealing the adjacent helical grooves (41).

Operation of adjusting the flow rate of the refrigeration oil supplied to the fluid chamber (23) will be described with reference to FIGS. 7 and 8.

In the state shown in FIG. 7, the slide valve (70) is pushed to be closest to the low pressure space (S1), and the end face (P2) of the slide valve (70) is in close contact with the seat surface (P1) of the cylindrical wall (30). In this state, the bypass passage (33) is completely closed by the valve portion (71) of the slide valve (70), and all the refrigerant sucked from the low pressure space (S1) to the fluid chamber (23) is discharged to the high pressure space (S2). Thus, in this state, the operating capacity of the screw compressor (1) is the highest.

In the state shown in FIG. 7, both of the first branch passage (133) and the second branch passage (134) of the movable oil passage (130) are opened in the recess (122) constituting the outlet end (121) of the stationary oil passage (120). Thus, the refrigeration oil which passed through the stationary oil passage (120) flows into both of the first branch passage (133) and the second branch passage (134), and then is discharged from the outlet end (132) of the movable oil passage (130) to the fluid chamber (23).

In the state shown in FIG. 8, the slide valve (70) is moved to be closest to the high pressure space (S2), and the distance between the end face (P2) of the slide valve (70) and the seat surface (P1) of the cylindrical wall (30) is the largest. Specifically, in this state, an opening area of the bypass passage (33) in the inner peripheral surface of the cylindrical wall (30) is the largest, and the flow rate of the gaseous refrigerant returned from the fluid chamber (23) to the low pressure space (S1) through the bypass passage (33) is the highest. Thus, in this state, the flow rate of the refrigerant discharged from the compression mechanism (20) to the high pressure space (S2) is the lowest, and the operating capacity of the screw compressor (1) is the lowest.

In the state shown in FIG. 8, only the first branch passage (133) of the movable oil passage (130) is opened in the recess (122) constituting the outlet end (121) of the stationary oil passage (120), and the second branch passage (134) is closed by the guide surface (37) of the bearing holder (35). Thus, the refrigeration oil which passed through the stationary oil passage (120) flows into the first branch passage (133) only, and then is discharged from the outlet end (132) of the movable oil passage (130) to the fluid chamber (23). In this state, an area of the inlet end (131) of the movable oil passage (130) overlapping with the outlet end (121) of the stationary oil passage (120) (i.e., an area in which the refrigeration oil flowing from the stationary oil passage (120) to the movable oil passage (130) passes) is smaller than that in the state shown in FIG. 7. Thus, in the state shown in FIG. 8, the flow rate of the refrigeration oil supplied from the movable oil passage (130) to the fluid chamber (23) is smaller than the flow rate of the refrigeration oil supplied in the state shown in FIG. 7.

When the distance between the end face (P2) of the slide valve (70) and the seat surface (P1) of the cylindrical wall (30) is smaller than a predetermined value, both of the first branch passage (133) and the second branch passage (134) of the movable oil passage (130) are opened in the stationary oil passage (120). When the distance between the end face (P2) of the slide valve (70) and the seat surface (P1) of the cylindrical wall (30) is the predetermined value or larger, only the first branch passage (133) of the movable oil passage (130) is opened in the stationary oil passage (120). Thus, the flow rate of the refrigeration oil supplied from the movable oil passage (130) to the fluid chamber (23) varies in a stepwise manner (in two steps in this embodiment) in accordance with change in operating capacity of the screw compressor (1).

—Advantages of First Embodiment—

In the screw compressor (1) of the present embodiment, the refrigeration oil is supplied to the fluid chamber (23) due to the difference in pressure between the oil sump (17) and the fluid chamber (23). Thus, unless special measures are taken, the flow rate of the refrigeration oil supplied to the fluid chamber (23) is kept constant as long as the difference in pressure between the oil sump (17) and the fluid chamber (23) is constant even when the operating capacity of the screw compressor (1) is changed.

In the screw compressor (1) of the present embodiment, the stationary oil passage (120) is formed in the bearing holder (35), the movable oil passage (130) is formed in the slide valve (70), and the area of the inlet end (131) of the movable oil passage (130) overlapping with the outlet end (121) of the stationary oil passage (120) varies depending on the position of the slide valve (70). In this screw compressor (1), the flow rate of the refrigeration oil supplied to the fluid chamber (23) through the stationary oil passage (120) and the movable oil passage (130) is reduced in accordance with the decrease in operating capacity of the screw compressor (1).

Specifically, in the screw compressor (1) of the present embodiment, the flow rate of the refrigeration oil actually supplied to the fluid chamber (23) is reduced when the operating capacity of the screw compressor is reduced, and a large amount of the refrigeration oil to the fluid chamber (23) is no longer necessary. When the amount of the refrigeration oil supplied to the fluid chamber (23) is reduced, power required to rotate the screw rotor (40) against the viscosity of the refrigeration oil is reduced, thereby reducing power consumed by the electric motor (15). Thus, the present embodiment can sufficiently reduce the power required to drive the screw rotor (40) when the operating capacity of the screw compressor (1) is reduced, and efficiency of operation of the screw compressor (1) can be kept high irrespective of the operating capacity of the screw compressor (1).

As described above, in the screw compressor (1) of the present embodiment, the area of the inlet end (131) of the movable oil passage (130) overlapping with the outlet end (121) of the stationary oil passage (120) is changed when the slide valve (70) is moved to change the operating capacity of the screw compressor (1), and the flow rate of the refrigeration oil supplied from the movable oil passage (130) to the fluid chamber (23) is changed. Thus, according to the present embodiment, the flow rate of the refrigeration oil supplied from the movable oil passage (130) to the fluid chamber (23) can be changed by using the slide valve (70) which is moved to change the operating capacity of the screw compressor (1). Thus, the present embodiment can reliably change the flow rate of the refrigeration oil supplied to the fluid chamber (23) in accordance with the operating capacity of the screw compressor (1) without providing additional sensors or controllers.

—Alternative of First Embodiment—

Figure 10:
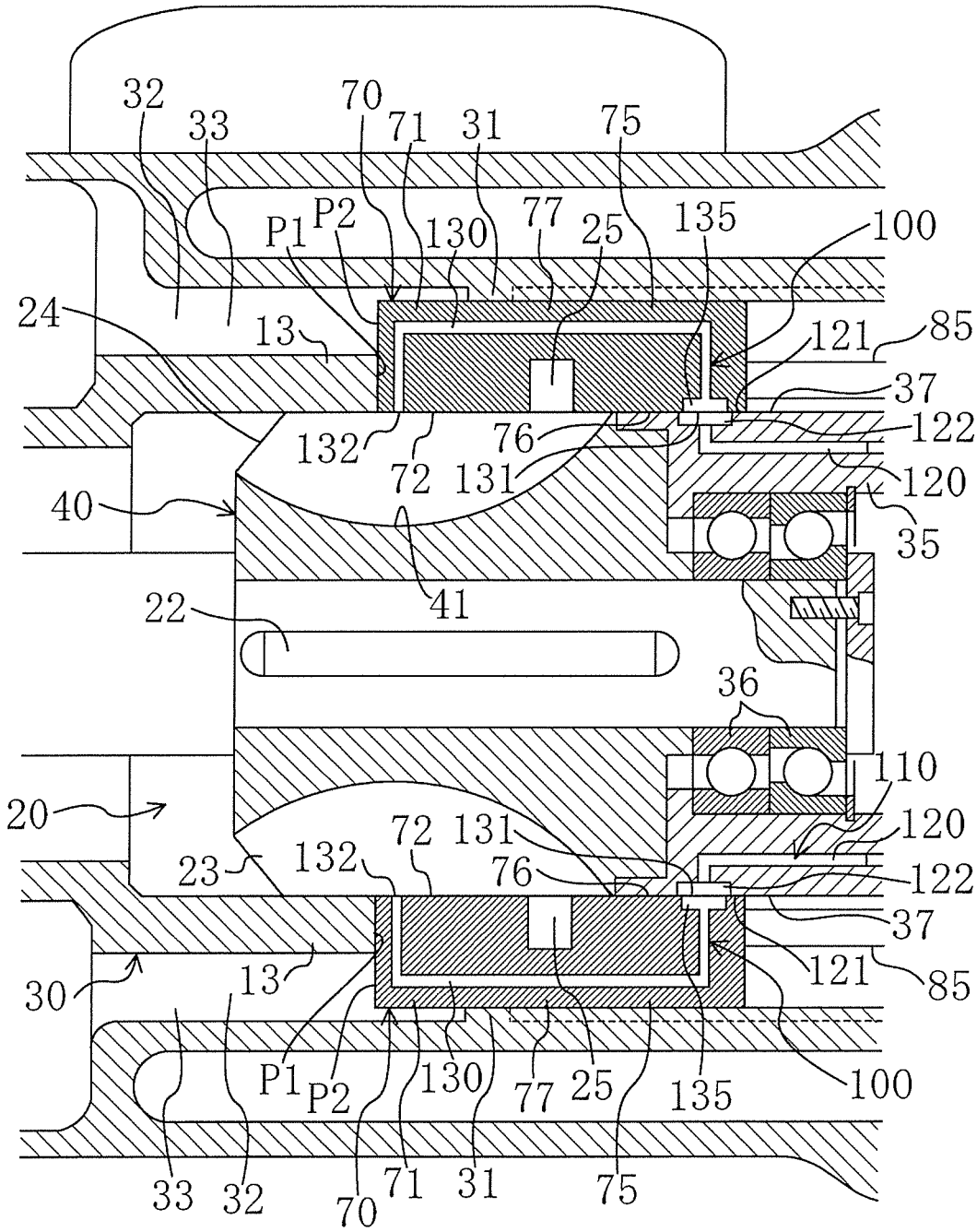
FIG. 10 is a view corresponding to FIG. 7 illustrating a single screw compressor of an alternative of the first embodiment.
Figure 11:
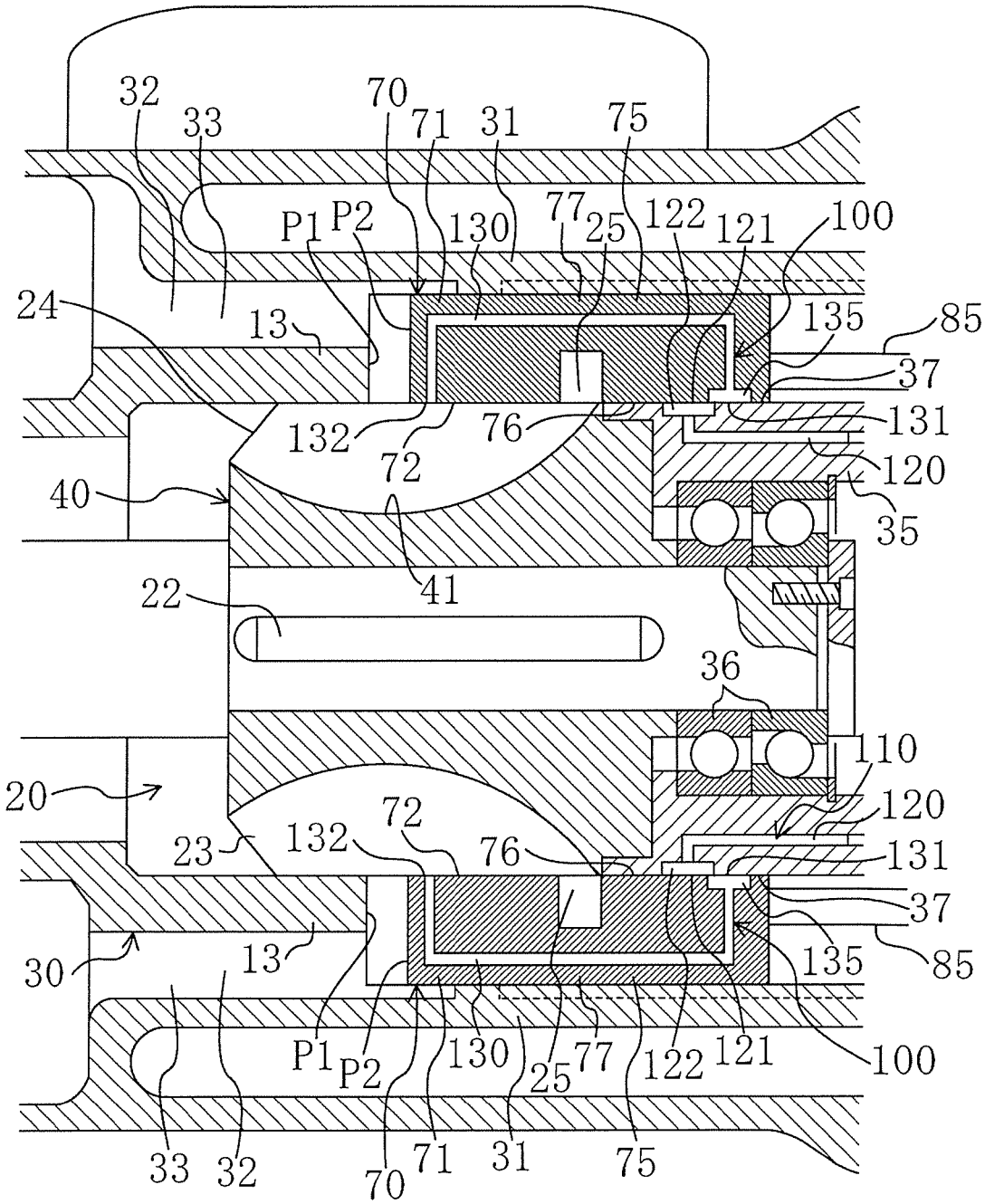
FIG. 11 is a view corresponding to FIG. 8 illustrating the single screw compressor of the alternative of the first embodiment.

As shown in FIGS. 10 and 11, the screw compressor (1) of the present embodiment may include a recess (135) formed in the sliding surface (76) of the guide portion (75) of the slide valve (70). In this alternative, the movable oil passage (130) is a single passage which is not branched, and the recess (135) constitutes the inlet end (131) thereof. The recess (135) is a relatively short groove extending in the sliding direction of the slide valve (70) (i.e., the axial direction of the screw rotor (40)).

The position of the recess (135) formed in the sliding surface (76) of the slide valve (70) will be described. In the state shown in FIG. 10, the slide valve (70) is pushed to be closest to the low pressure space (S1), and the end face (P2) of the slide valve (70) is in close contact with the seat surface (P1) of the cylindrical wall (30). In the state shown in FIG. 11, the slide valve (70) is moved to be closest to the high pressure space (S2), and the distance between the end face (P2) of the slide valve (70) and the seat surface (P1) of the cylindrical wall (30) is the largest. The recess (135) constituting the inlet end (131) of the movable oil passage (130) completely overlaps with the recess (122) of the bearing holder (35) in the state shown in FIG. 10, while the recess (135) is partially overlaid on the recess (122) in the state shown in FIG. 11.

In the state shown in FIG. 10, the bypass passage (33) is completely closed by the valve portion (71) of the slide valve (70), and the operating capacity of the screw compressor (1) is the highest. In this state, the recess (135) constituting the inlet end (131) of the movable oil passage (130) completely overlaps with the recess (122) constituting the outlet end (121) of the stationary oil passage (120). Thus, the refrigeration oil which passed through the stationary oil passage (120) flows into the movable oil passage (130) through the whole part of the recess (135) in the sliding surface (76) of the slide valve (70), and then is discharged from the outlet end (132) of the movable oil passage (130) to the fluid chamber (23).

In the state shown in FIG. 11, an opening area of the bypass passage (33) formed in the inner peripheral surface of the cylindrical wall (30) is the largest, and the operating capacity of the screw compressor (1) is the lowest. In this state, only part of the recess (135) constituting the inlet end (131) of the movable oil passage (130) overlaps with the recess (122) constituting the outlet end (121) of the stationary oil passage (120). Thus, the refrigeration oil which passed through the stationary oil passage (120) flows into the movable oil passage (130) only through the part of recess (135) formed in the sliding surface (76) of the slide valve (70), and then is discharged from the outlet end (132) of the movable oil passage (130) to the fluid chamber (23).

In the screw compressor (1) of this alternative example, a length of the part of the recess (135) formed in the slide valve (70) overlapping with the recess (122) formed in the bearing holder (35) is continuously changed in accordance with the distance between the end face (P2) of the slide valve (70) and the seat surface (P1) of the cylindrical wall (30). Thus, the flow rate of the refrigeration oil supplied from the movable oil passage (130) to the fluid chamber (23) is continuously changed in accordance with the change in operating capacity of the screw compressor (1).

[Second Embodiment]

A second embodiment of the present invention will be described. The screw compressor (1) of the present embodiment is provided by adding an inverter (200), a controller (140), and a flow rate control valve (111) to the screw compressor (1) of the first embodiment. In the screw compressor (1) of the present embodiment, the shapes of the stationary oil passage (120) and the movable oil passage (130) are different from those of the first embodiment. The differences between the screw compressor (1) of the present embodiment and the screw compressor of the first embodiment will be described below.

Figure 12:
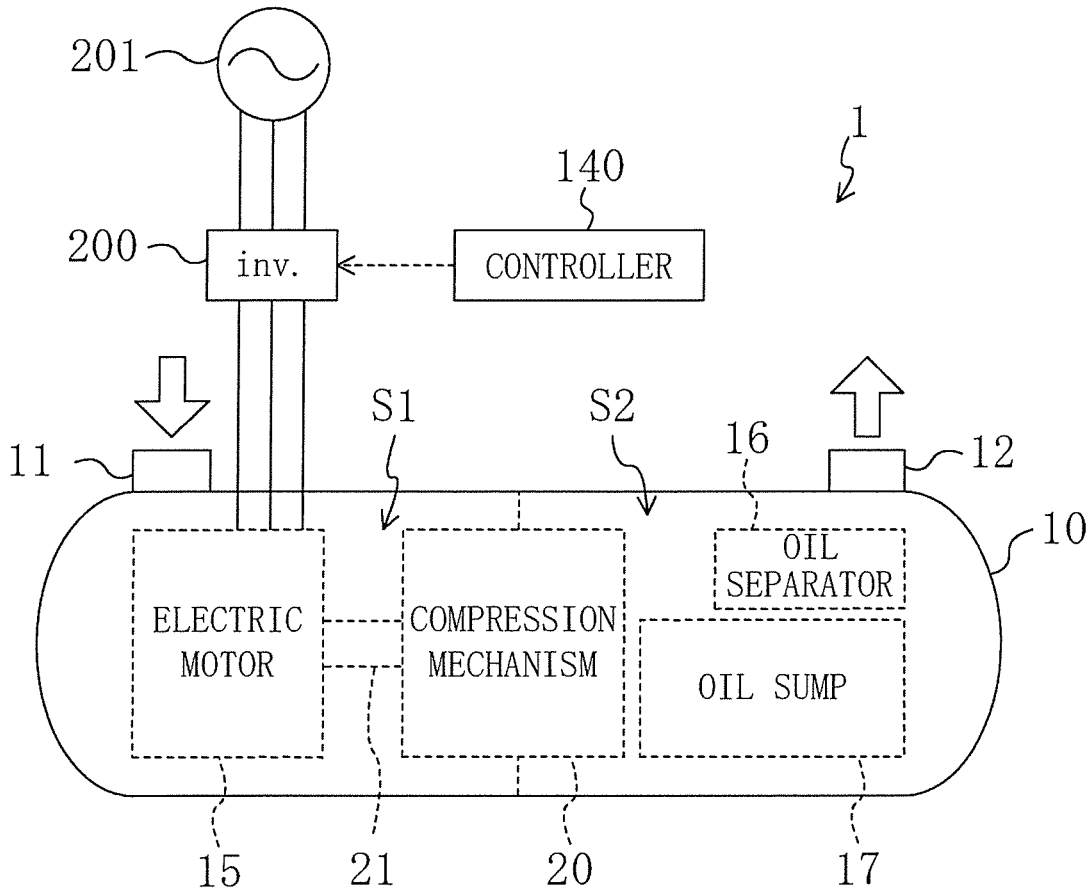
FIG. 12 is a schematic view illustrating a single screw compressor of a second embodiment.

As shown in FIG. 12, the screw compressor (1) of the present embodiment includes the inverter (200). The inverter (200) is connected to a commercial power supply (201) through an input end thereof, and is connected to an electric motor (15) through an output end thereof. The inverter (200) adjusts a frequency of alternating current input from the commercial power supply (201), and supplies the alternating current converted to the predetermined frequency to the electric motor (15).

When the output frequency of the inverter (200) is changed, rotational speed of the electric motor (15) is changed, and rotational speed of the screw rotor (40) driven by the electric motor (15) is changed. The change in rotational speed of the screw rotor (40) changes a mass flow rate of the fluid which is sucked into the single screw compressor (1) and discharged after compression. Specifically, the change in rotational speed of the screw rotor (40) changes operating capacity of the single screw compressor (1).

Figure 13:
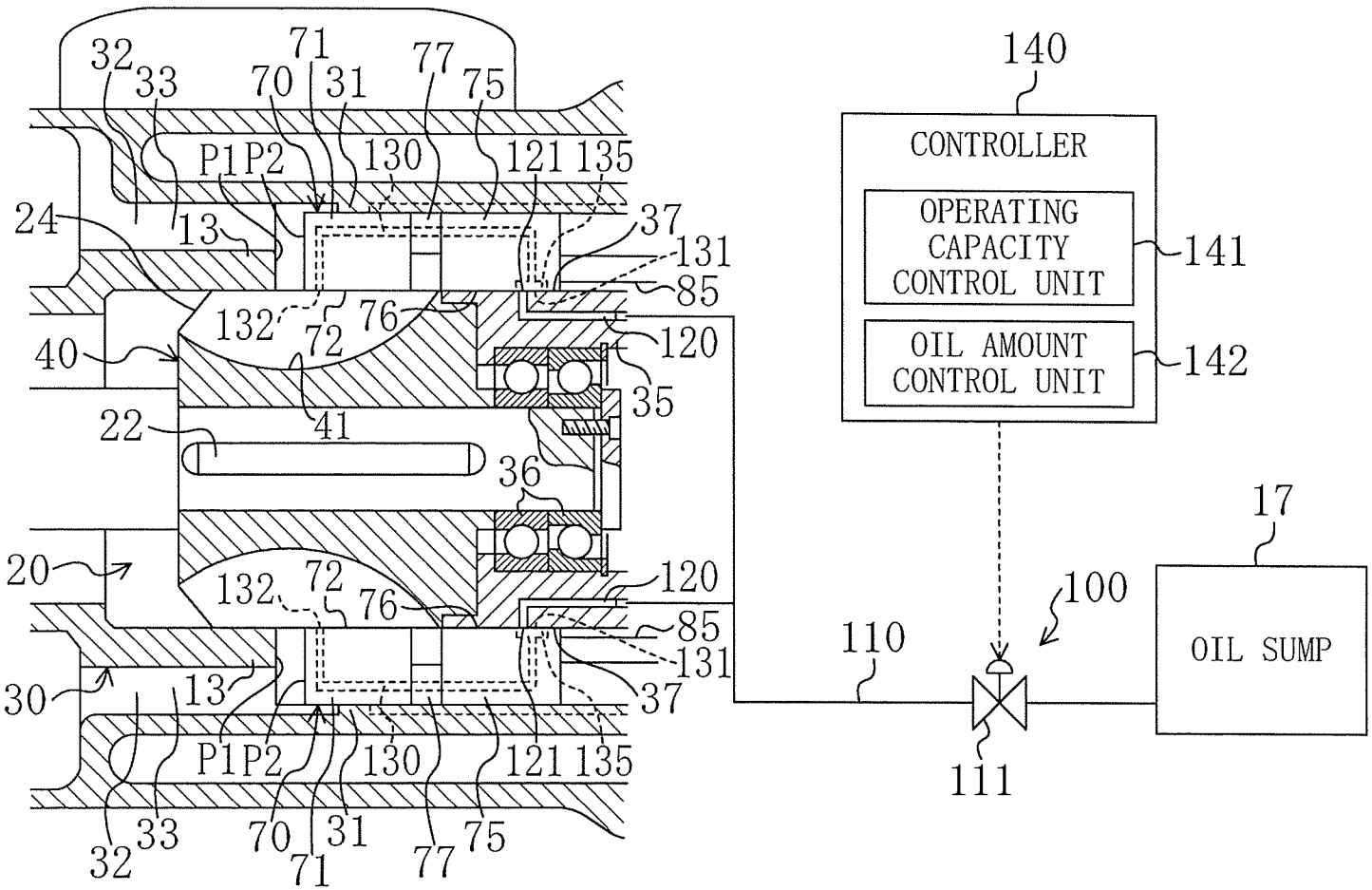
FIG. 13 is a schematic view illustrating a major part of the single screw compressor of the second embodiment.
Figure 14:
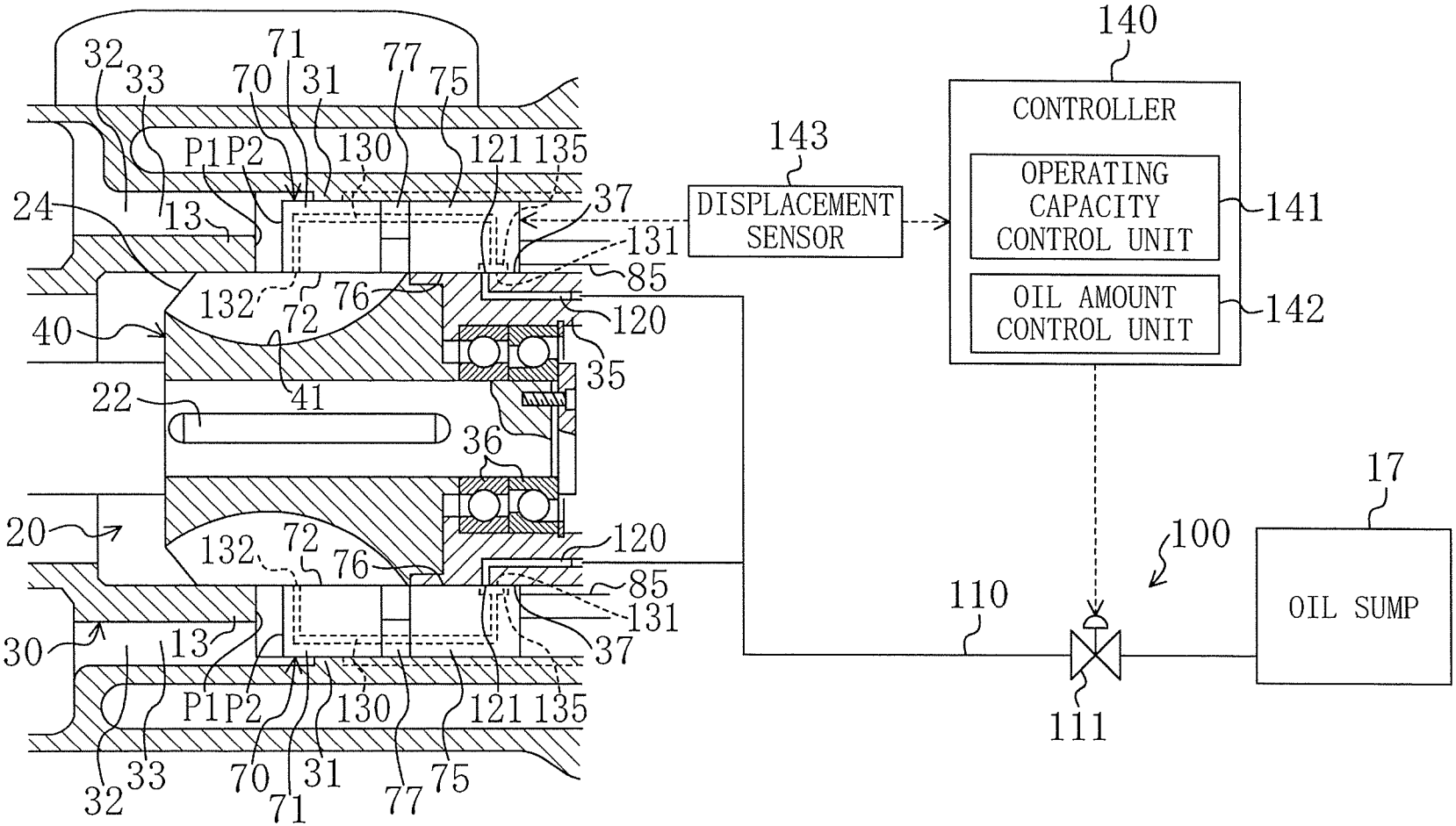
FIG. 14 is a schematic view illustrating the major part of a single screw compressor of the third embodiment.

As shown in FIG. 13, the screw compressor (1) of the present embodiment includes the flow rate control valve (111) in the lubrication passage (110). The flow rate control valve (111) is a so-called motor-operated valve, and the degree of opening can be adjusted in a continuous or stepwise manner. When the degree of opening of the flow rate control valve (111) is changed, the flow rate of the refrigeration oil flowing through the lubrication passage (110) (i.e., the flow rate of the refrigeration oil supplied to the fluid chamber (23)) is changed. The flow rate control valve (111) may be contained in the casing (10), or may be arranged in a pipe provided outside the casing (10).

The controller (140) includes an operating capacity control unit (141), and an oil amount control unit (142).

The operating capacity control unit (141) is configured to adjust the rotational speed of the screw rotor (40) in accordance with a load of the screw compressor (1). Specifically, the operating capacity control unit (141) is configured to determine a command value of the output frequency of the inverter (200) in accordance with the load of the screw compressor (1), and to output the determined command value to the inverter (200).

For example, when the pressure of the low pressure refrigerant sucked into the low pressure space (S1) (i.e., the low pressure of the refrigeration cycle) is lower than the predetermined target value, the operating capacity control unit (141) determines that the operating capacity of the screw compressor (1) is too high, and reduces the command value of the output frequency of the inverter (200). When the output frequency of the inverter (200) is reduced, the rotational speed of the screw rotor (40) driven by the electric motor (15) is reduced, and the operating capacity of the screw compressor (1) is reduced.

For example, when the pressure of the low pressure refrigerant sucked into the low pressure space (S1) is higher than the predetermined target value, the operating capacity control unit (141) determines that the operating capacity of the screw compressor (1) is too low, and increases the command value of the output frequency of the inverter (200). When the output frequency of the inverter (200) is increased, the rotational speed of the screw rotor (40) driven by the electric motor (15) is increased, and the operating capacity of the screw compressor (1) is increased.

The oil amount control unit (142) is configured to adjust the flow rate of the refrigeration oil supplied to the fluid chamber (23) through the lubrication passage (110) in accordance with the operating capacity of the screw compressor (1). The oil amount control unit (142) constitutes an opening controller for adjusting the degree of opening of the flow rate control valve (111). The oil amount control unit (142) constitutes a flow rate controller (100) together with the flow rate control valve (111).

Specifically, the command value of the output frequency determined by the operating capacity control unit (141) is input to the oil amount control unit (142). The oil amount control unit (142) determines a command value of the degree of opening of the flow rate control valve (111) in accordance with the command value of the output frequency of the inverter (200), and adjusts the degree of opening of the flow rate control valve (111) to the command value. For example, when the command value of the output frequency of the inverter (200) is the highest, the oil amount control unit (142) sets the degree of opening of the flow rate control valve (111) to the highest degree. The oil amount control unit (142) reduces the degree of opening of the flow rate control valve (111) in a continuous or stepwise manner in accordance with the decrease in command value of the output frequency of the inverter (200). Thus, the flow rate of the refrigeration oil supplied to the fluid chamber (23) through the lubrication passage (110) is reduced in a continuous or stepwise manner in accordance with the decrease in operating capacity of the screw compressor (1).

The oil amount control unit (142) does not fully open the flow rate control valve (111) even when the command value of the output frequency of the inverter (200) is the lowest. Thus, the amount of the refrigeration oil supplied to the fluid chamber (23) can be ensured even when the operating capacity of the screw compressor (1) is set to a lower limit value.

As described above, in the screw compressor (1) of the present embodiment, the shapes of the stationary oil passage (120) and the movable oil passage (130) are different from those of the first embodiment.

Specifically, the recess (122) is not formed in the bearing holder (35) of the present embodiment. Thus, the shape of the outlet end (121) of the stationary oil passage (120) in the guide surface (37) of the bearing holder (35) is the same as the shape of part of the stationary oil passage (120) connected to the outlet end (121).

The slide valve (70) of the present embodiment includes a recess (135) formed in the sliding surface (76) of the guide portion (75). The movable oil passage (130) of the present embodiment is a single passage which is not branched, and the recess (135) constitutes the inlet end (131) thereof. The recess (135) is a relatively short groove extending in the sliding direction of the slide valve (70) (i.e., the axial direction of the screw rotor (40)). The whole part of the outlet end (121) of the stationary oil passage (120) is opened in the recess (135) irrespective of the position of the slide valve (70).

—Alternative of Second Embodiment—

In the screw compressor (1) of the present embodiment, the slide valve (70) may be omitted. The operating capacity of the screw compressor (1) of this alternative is adjusted by merely changing the rotational speed of the screw rotor (40).

In the screw compressor (1) of this alternative, the stationary oil passage (120) is formed in the cylindrical wall (30). In the cylindrical wall (30) of this alternative, the outlet end of the stationary oil passage (120) is opened in the inner peripheral surface of the cylindrical wall (30) which slides on the outer peripheral surface of the screw rotor (40). The refrigeration oil flowing from the oil sump (17) to the stationary oil passage (120) is discharged from the outlet end of the stationary oil passage (120) to the fluid chamber (23).

[Third Embodiment]

A third embodiment of the present invention will be described below. The screw compressor (1) of the present embodiment is different from the screw compressor (1) of the second embodiment except that the inverter (200) is omitted, a displacement sensor (143) is added, and the structure of the controller (140) is changed. The differences between the screw compressor (1) of the present embodiment and the screw compressor of the second embodiment will be described below.

The displacement sensor (143) is arranged to abut the slide valve (70), or an arm (84) or a coupling rod (85) coupled to the slide valve (70). The displacement sensor (143) outputs signals corresponding to the position of the slide valve (70) etc. to which the sensor abuts to the controller (140).

An operating capacity control unit (141) is configured to adjust the position of the slide valve (70) in accordance with the load of the screw compressor (1). Specifically, the operating capacity control unit (141) moves the slide valve (70) toward the high pressure space (S2) when it is determined that the operating capacity of the screw compressor (1) is too high, or moves the slide valve (70) toward the low pressure space (S1) when it is determined that the operating capacity of the screw compressor (1) is too low.

An oil amount control unit (142) is configured to adjust the flow rate of the refrigeration oil supplied to the fluid chamber (23) through the lubrication passage (110) in accordance with the operating capacity of the screw compressor (1). The oil amount control unit (142) constitutes a flow rate controller (100) together with the flow rate control valve (111).

Specifically, a signal output from the displacement sensor (143) (i.e., a signal representing the position of the slide valve (70)) is input to the oil amount control unit (142). The oil amount control unit (142) determines a command value of the degree of opening of the flow rate control valve (111) based on the output signal from the displacement sensor (143), and controls the degree of opening of the flow rate control valve (111) to the command value. For example, when it is determined that the slide valve (70) is positioned closest to the low pressure space (S1) based on the output signal from the displacement sensor (143), the oil amount control unit (142) sets the degree of opening of the flow rate control valve (111) to the highest. The oil amount control unit (142) reduces the degree of opening of the flow rate control valve (111) in a continuous or stepwise manner as the slide valve (70) is moved to increase the distance between the end face (P2) and the seat surface (P1). Thus, the flow rate of the refrigeration oil supplied to the fluid chamber (23) through the lubrication passage (110) is reduced in a continuous or stepwise manner in accordance with the decrease in operating capacity of the screw compressor (1).

The oil amount control unit (142) does not fully open the flow rate control valve (111) even when it is determined that the slide valve (70) is positioned closest to the high pressure space (S2). Thus, the amount of the refrigeration oil supplied to the fluid chamber (23) can be ensured even when the operating capacity of the screw compressor (1) is adjusted to a lower limit value.

[Other Embodiments]

—First Alternative—

Figure 15:
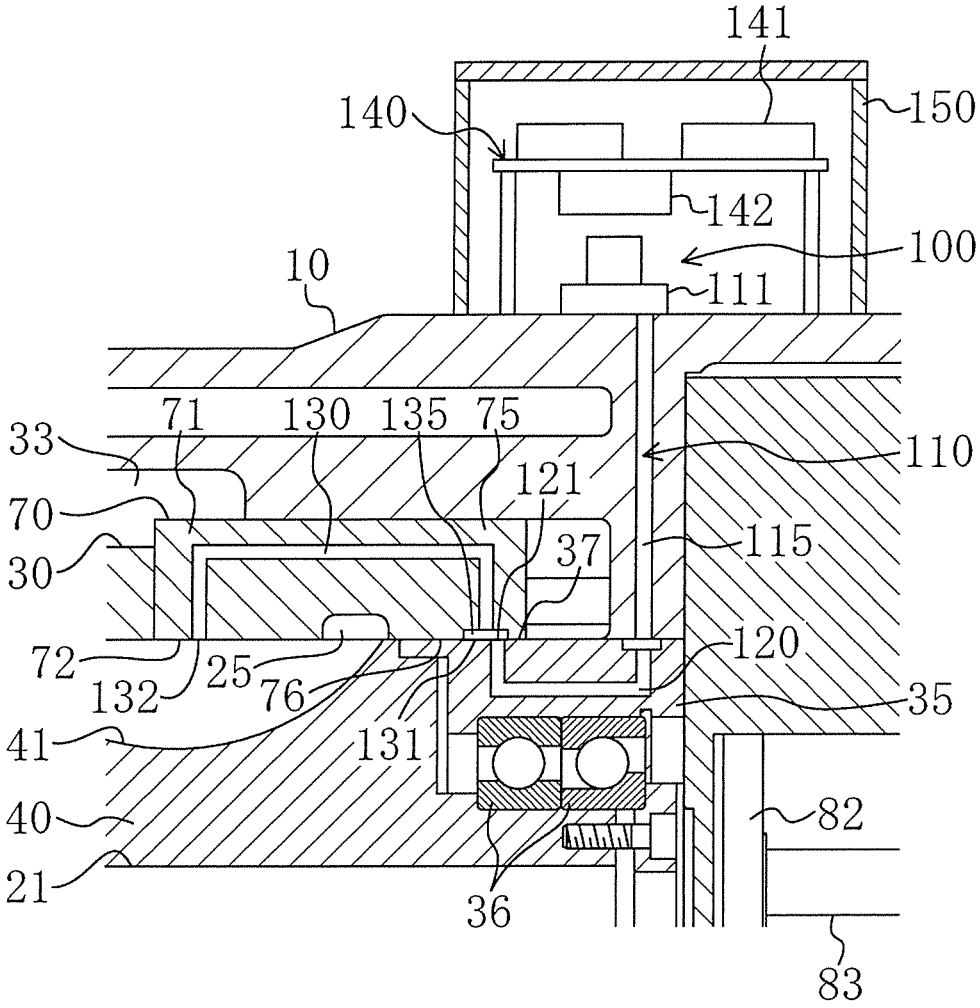
FIG. 15 is a schematic cross-sectional view illustrating a major part of a single screw compressor of a first alternative of the other embodiment.

In the screw compressor (1) of the second or third embodiment, both of the controller (140) and the flow rate control valve (111) are preferably attached to the casing (10) as shown in FIG. 15.

In the screw compressor (1) shown in FIG. 15, the controller (140) and the flow rate control valve (111) are attached to an outer peripheral surface of the casing (10). The controller (140) is a printed board on which microprocessors etc. constituting the operating capacity control unit (141) and the oil amount control unit (142) are mounted. A cover (150) is provided to cover the controller (140) and the flow rate control valve (111) attached to the casing (10). Although not shown, the oil amount control unit (142) and the flow rate control valve (111) of the controller (140) are electrically connected to each other through wires.

The casing (10) of the screw compressor (1) shown in FIG. 15 includes an oil circulating passage (115) which partially constitutes the lubrication passage (110). The refrigeration oil which passed through the flow rate control valve (111) flows through the oil circulating passage (115) to enter the stationary oil passage (120) of the bearing holder (35), and then is supplied to the fluid chamber (23) through the movable oil passage (130) of the slide valve (70).

As described above, the flow rate control valve (111) is attached to the casing (10) in the screw compressor (1) shown in FIG. 15. Thus, as compared with the case where the flow rate control valve (111) is arranged away from the casing (10), the lubrication passage (110) can be shortened. Thus, the change in flow rate of the refrigeration oil can be more responsive to the change in degree of opening of the flow rate control valve (111), and the flow rate of the refrigeration oil supplied to the fluid chamber (23) can precisely be adjusted.

In the screw compressor (1) shown in FIG. 15, both of the flow rate control valve (111) and the oil amount control unit (142) are attached to the casing (10). Thus, connecting the flow rate control valve (111) and the opening controller (142) through wires etc. can be performed in assembling the screw compressor (1) (i.e., before shipping of the screw compressor (1) from the factory). Therefore, in setting the screw compressor (1), the connection of the flow rate control valve (111) and the oil amount control unit (142) is no longer necessary, thereby facilitating the setting of the screw compressor (1).

In the screw compressor (1) shown in FIG. 15, not only the flow rate control valve (111) and the oil amount control unit (142), but also the operating capacity control unit (141) is attached to the casing (10). Thus, almost every devices required for controlling the operation of the screw compressor (1) can be attached to the casing (10) before the shipping of the screw compressor (1), thereby further facilitating the setting of the screw compressor (1).

—Second Alternative—

In the screw compressor (1) of the second or third embodiment, the movable oil passage (130) may be omitted, and the stationary oil passage (120) may be formed in the cylindrical wall (30). Specifically, in this alternative, the movable oil passage (130) is not provided in the slide valve (70). In the cylindrical wall (30) of this alternative, the outlet end of the stationary oil passage (120) is opened in the inner peripheral surface of the cylindrical wall (30) which slides on the outer peripheral surface of the screw rotor (40). The refrigeration oil flowed from the oil sump (17) to the stationary oil passage (120) is discharged from the outlet end of the stationary oil passage (120) to the fluid chamber (23).

—Third Alternative—

In the screw compressor (1) of the above embodiments, the oil sump (17) may be arranged outside the casing (10). In this case, a hermetic container is provided near the casing (10), and space inside the container constitutes the oil sump (17).

—Fourth Alternative—

In the above embodiments, the present invention has been applied to the single screw compressors. However, the present invention may be applied to twin screw compressors (so-called Lysholm compressors).

INDUSTRIAL APPLICABILITY

As described above, the present invention is useful for screw compressors.

What is claimed is:

1. A screw compressor comprising:

a casing;

a screw rotor inserted in a cylinder portion of the casing to form a fluid chamber, the screw rotor being arranged to rotate to suck a fluid into the fluid chamber for compression;

an oil sump containing lubricant oil;

a lubrication passage arranged to supply the lubricant oil in the oil sump to the fluid chamber due to a difference in pressure between the oil sump and the fluid chamber;

a flow rate controller configured to reduce a flow rate of the lubricant oil supplied to the fluid chamber in accordance with a decrease in operating capacity of the screw compressor;

a low pressure space formed in the casing, the low pressure space being arranged to have uncompressed, low pressure fluid flow into the low pressure space;

a bypass passage opened in an inner peripheral surface of the cylinder portion to communicate the fluid chamber, which finished a suction phase, with the low pressure space; and a slide valve slidable in an axial direction of the screw rotor to change an opening area of the bypass passage in the inner peripheral surface of the cylinder portion, the lubrication passage including a stationary oil passage having an outlet end opened in a sliding surface of the cylinder portion slidable relative to the slide valve, and a movable oil passage having an inlet end opened in a sliding surface of the slide valve slidable relative to the cylinder portion, and an outlet end opened in a sliding surface of the slide valve slidable relative to the screw rotor, the stationary oil passage and the movable oil passage being configured in such a manner that an area of the inlet end of the movable oil passage overlapping with the outlet end of the stationary oil passage is reduced as the slide valve is moved to increase the opening area of the bypass passage, and the stationary oil passage and the movable oil passage forming parts of the flow rate controller.

2. The screw compressor of claim 1, wherein the inlet end of the movable oil passage is divided into a plurality of branch passages, and the branch passages of the movable oil passage are opened in the sliding surface of the cylinder portion slidable relative to the slide valve in such a manner that a number of the branch passages communicating with the stationary oil passage is reduced as the slide valve is moved to increase the opening area of the bypass passage.

* * * * *